US008758171B2

(12) United States Patent
Hasegawa et al.

(10) Patent No.: US 8,758,171 B2
(45) Date of Patent: Jun. 24, 2014

(54) METHOD FOR SELECTING GOLF CLUB

(75) Inventors: Hiroshi Hasegawa, Kobe (JP); Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 126 days.

(21) Appl. No.: 13/275,401

(22) Filed: Oct. 18, 2011

(65) Prior Publication Data

US 2012/0108363 A1 May 3, 2012

(30) Foreign Application Priority Data

Nov. 2, 2010 (JP) ..... 2010-246394

(51) Int. Cl.
*A63B 69/36* (2006.01)

(52) U.S. Cl.
USPC ..... 473/409

(58) Field of Classification Search
CPC .... A63B 24/0003; A63B 53/00; A63B 53/10; A63B 69/36
USPC ..... 473/290, 238, 409
See application file for complete search history.

(56) References Cited

U.S. PATENT DOCUMENTS

| | | | | |
|---|---|---|---|---|
| 6,083,123 | A * | 7/2000 | Wood | 473/409 |
| 2004/0127303 | A1 | 7/2004 | Teraoka | |
| 2006/0211510 | A1 | 9/2006 | Ashida et al. | |
| 2009/0326688 | A1 * | 12/2009 | Thomas et al. | 700/91 |

FOREIGN PATENT DOCUMENTS

| | | | |
|---|---|---|---|
| JP | 4-224778 | A | 8/1992 |
| JP | 2006-247023 | A | 9/2006 |
| JP | 2006-289073 | A | 10/2006 |
| JP | 2010-155074 | A | 7/2010 |

* cited by examiner

*Primary Examiner* — Michael Dennis
(74) *Attorney, Agent, or Firm* — Birch, Stewart, Kolasch & Birch, LLP

(57) ABSTRACT

The fitting method includes a step of preparing a relationship C in which a face angle at or before impact and a hitting result are considered when a plurality of golf players swing using a plurality of golf clubs with different head physical property values; a step of obtaining measurement result of the face angle by a subject (golf player) hitting a ball with a test club; and a step of determining a head physical property fitted to the subject on the basis of the relationship C and the measurement result of the face angle. Preferably, the relationship C is a relational expression F1. The relational expression F1 may be a relational expression F11 of the face angle and the hitting results. The relational expression F1 may be a relational expression F12 of the face angle and the head physical properties.

24 Claims, 15 Drawing Sheets

METHOD FOR SELECTING GOLF CLUB

This application involves a claim for benefits based on Japanese Patent Application No. 2010-246394 filed in Japan on Nov. 2, 2010, the entire contents of which are hereby incorporated by reference.

BACKGROUND OF THE INVENTION

1. Field of the Invention

The present invention relates to fitting of a golf club.

2. Description of the Related Art

Selection of a golf club fitted to a golf player is called fitting. One who performs fitting of a golf club is called a fitter. Physical properties of a head have a great influence on the fitting.

For example, one of the head physical properties is a loft angle. A typical loft angle is a real loft angle. The real loft angle is an angle of inclination of a face surface to a shaft axial line. In general, a fit loft angle is selected based on a launch angle and a backspin rate.

As other head physical property, a centroid position is exemplified. In fitting based on the centroid position, there is no other way than relying on experience and intuition of a fitter. Fitting by a fitter involves variations, etc. due to the fitter's subjectivity. Thus, in such fitting, a golf club to be selected will be different if a fitter differs.

Hence, it is proposed to measure swings of a golf player and perform fitting based on result of the measurement. In Japanese Patent Application Laid-Open No. 2010-155074, a combination of a head and a shaft is selected based on behavior of the head. In Japanese Patent Application Laid-Open No. 2003-102892 (US2004/127303), hitting data is acquired, and a golf club which is believed to be approximate to ideal hitting data is selected.

SUMMARY OF THE INVENTION

However, with these methods, establishment of a relationship between hitting result and fitting is inadequate.

An objective of the present invention is to provide an analysis method for determining an indicator associated with hitting result of a golf club. A further objective of the present invention is to provide a fitting method and a fitting device of a golf club using the indicator.

The fitting method of the present invention includes a step of preparing a relationship C in which a face angle before or at impact and hitting result are considered when a plurality of golf players swing with a plurality of golf clubs having different values of head physical properties, a step of obtaining a measurement result of the face angle when subjects (golf players) hit a ball with a test club, and a step of determining the physical property of the head fitted to the subject on the basis of the relationship C and the measurement result the face angle.

Preferably, the relationship C is a relational expression F1.

The relational expression F1 may be a relational expression F11 of the face angle and the hitting result.

The relational expression F1 may be a relational expression F12 of the face angle and the head physical property. Preferably, in the relational expression F12, a correlation Rx of the hitting result and the face angle has been considered.

Preferably, the relational expression F12 is such a relational expression that the greater the face angle to be measured is, the more at the heel side a recommended centroid position (center of gravity) of the head is.

Preferably, a preferred hitting result at a standard centroid position Gh of the head is reflected in the relational expression F12.

Preferably, two or more hitting results are considered in the relational expression F12.

Preferably, the relational expression F12 has been created by modifying a relational expression based on a first hitting result, on the basis of a second hitting result.

Preferably, the modification based on the second hitting result is such a modification that the second hitting result will be preferable at a standard centroid position Gh of the head.

Preferably, the first hitting result is a direction of a hit ball. Preferably, the second hitting result is a flight distance.

Preferably, in the relational expression F12, the measured face angle is a first input variable, a value representative of a relationship of a centroid position D1 of the head of the test club and the standard centroid position Gh of the head is a second input variable, and a centroid position Y of the head fitted to the subject is a result variable.

Preferably, the head physical property is a centroid position of the head. Preferably, the relational expression F1 is a linear expression. Preferably, the hitting result is a right/left direction in which a ball flies.

Other fitting method includes a step of using a plurality of golf clubs having different values of head physical properties and acquiring multiple pieces of measurement data and hitting results of a golf player, a step of obtaining a characteristic value on the basis of the measurement data, a step of determining an indicator for selecting a golf club head from the characteristic value and the hitting results, a step of obtaining a relational expression F1 of the indicator and the hitting results for each value of the head physical properties, a step of obtaining a measurement result corresponding to the indicator when a subject (golf player) hits a ball with a test club, and a step of determining a physical property of a head fitted to the subject, on the basis of the relational expression F1 and the measurement result. Preferably, in the step of acquiring the multiple pieces of measurement data and hitting results, multiple pieces of measurement data are acquired from the golf player's swings and hit balls of the swings. Preferably, in the step of determining the indicator, the hitting result is made an objective variable, the characteristic value and the value of the head physical property are made an explanatory variable, and the characteristic value is determined to be the indicator when the characteristic value has a statistically significant relationship with the hitting result.

Preferably, in the step of determining the indicator, a plurality of indicators is determined. Preferably, the fitting method further includes a step of calculating an accuracy rate of the value of the head physical property which has been determined from the plurality of indicators, and a step of selecting an indicator to be used in fitting of a golf club on the basis of the accuracy rate. Preferably, in the step of calculating the accuracy rate of the value of the head physical property, a value Xa of the fit head physical property is selected based on the relational expression F1 of the indicator and the hitting result, a value Xb of the fit head physical property is determined based on the value of the hitting result obtained from the swing, a rate of golf players for whom the value Xa and the value Xb match is calculated, and the rate is the accuracy rate. Preferably, in the step of selecting an indicator to be used in fitting of the golf club, an indicator for which the accuracy rate is highest is selected as an indicator to be used in fitting.

Preferably, the hitting result is a flight distance of a ball. Preferably, the head physical property is a centroid position of the head. Preferably, the characteristic value is a face angle before or at impact.

Preferably, the hitting result is a right/left direction in which a ball flies. Preferably, the head physical property is a centroid position of the head. Preferably, the characteristic value is a face angle before or at impact.

Preferably, for a value Y of each centroid position of the head, a value X of the face angle for which an absolute value of a ball flying direction is 0 is determined. Preferably, an approximate expression which satisfies a relationship of the value Y of each centroid position of a plurality of heads and the value X of the face angle $$Y=A1\cdot X+B$$

(coefficient A1 and intercept B are a constant) is determined, and the approximate expression is the relational expression F1.

Preferably, the intercept B is modified based on a relationship of a flight distance of a ball and a value of the face angle.

A fitting device of the present invention includes an image shooting section or sensor which acquires measurement data from swings of a subject (golf player) and hit balls of the swings, and a calculating section. Preferably, the calculating section determines fit head physical properties, on the basis of an indicator to be obtained from the measurement data. Preferably, in the determination of the head physical properties, hitting result of the golf club is made an objective variable, a characteristic value to be obtained from the measurement data and a value of the head physical properties are made an explanatory variable, and the characteristic value is an indicator when the characteristic value has a statistically significant relationship with the hitting result. Preferably, a relational expression F1 of the indicator and the hitting result is calculated for each value of the head physical properties. Preferably, the hitting result is determined from the indicator and the relational expression F1. Preferably, a head physical property for which the hitting result is best is determined to be a fit head physical property.

A swing analysis method of the present invention includes a step of using a plurality of golf clubs having different values of head physical properties and acquiring multiple pieces of measurement data and hitting results of a golf player, a step of obtaining a characteristic value on the basis of the measurement data, a step of determining an indicator for selecting a golf club head from the characteristic value and the hitting results, and a step of obtaining a relational expression F1 of the indicator and the hitting result for each value of the head physical properties. In the step of acquiring the multiple pieces of measurement data and hitting results, multiple pieces of measurement data are acquired from swings of a golf player and hit balls of the swings. In the step of determining the indicator, the hitting result is made an objective variable, the characteristic value and the value of the head physical property are made an explanatory variable, and the characteristic value is determined to be the indicator when the characteristic value has a statistically significant relationship with the hitting result.

Preferably, in the step of determining the indicator, a plurality of indicators is determined. Preferably, the swing analysis method further includes a step of calculating an accuracy rate of values of head physical properties which have been determined from the plurality of indicators, and a step of selecting an indicator to be used in fitting of a golf club on the basis of the accuracy rate. Preferably, in the step of calculating the accuracy rate of the values of the head physical properties, a value Xa of a fit head physical property is selected based on the relational expression F1 of the indicator and the hitting result, a value Xb of a fit head physical property is determined based on a value of the hitting result obtained from the swings, a rate of golf players for which the value Xa and the value Xb match is calculated, and the rate is an accuracy rate. Preferably, in the step of selecting the indicator to be used in fitting of a golf club, an indicator for which the accuracy rate is highest is selected to be an indicator to be used in fitting.

Preferably, the hitting result is a flight distance of a ball. Preferably, the head physical property is a centroid position of the head. Preferably, the characteristic value is a face angle before or at impact.

Preferably, the hitting result is a right/left direction in which a ball flies. Preferably, the head physical property is a centroid position of the head. Preferably, the characteristic value is a face angle before or at impact.

DESCRIPTION OF THE PREFERRED EMBODIMENTS

The present invention will be described in detail hereinafter with reference to the drawings, as appropriate, and based on preferred embodiments.

Figure 1:
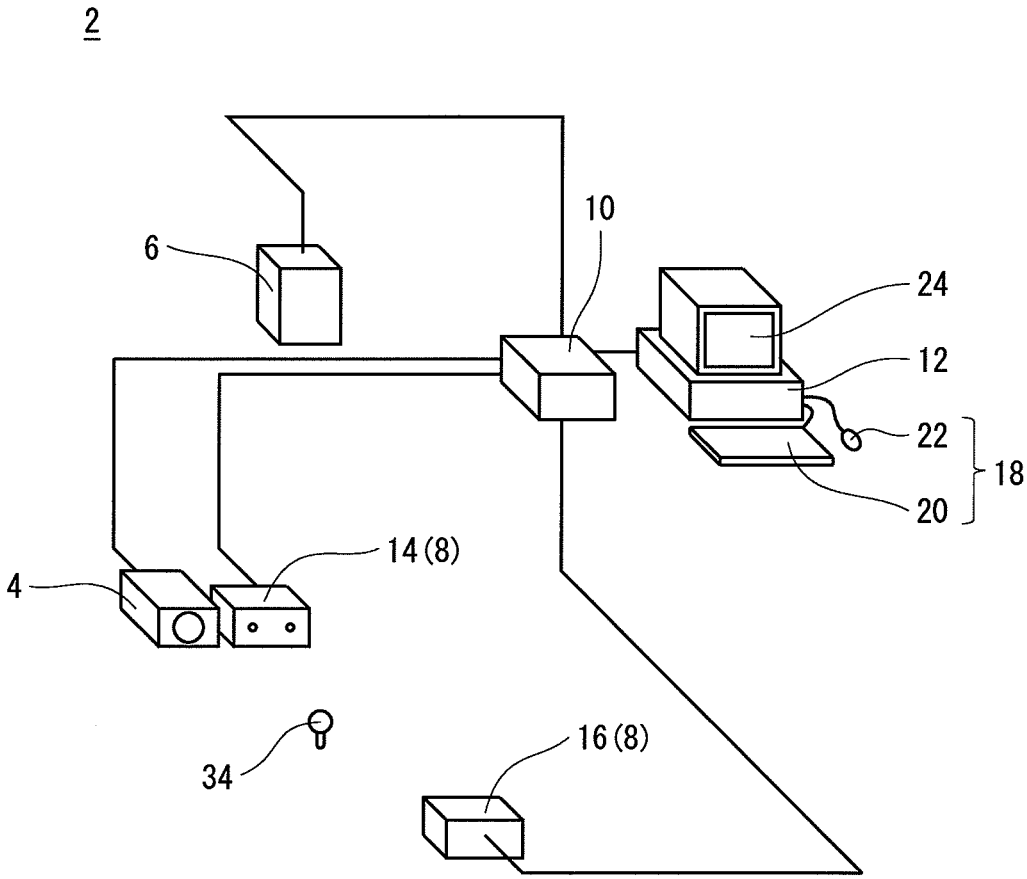
FIG. 1 is a schematic view showing a configuration of a fitting device according to the present invention.

FIG. 1 shows a fitting device 2 of a golf club to be used for a right-handed golf player, by way of example. The fitting device 2 includes a front face camera 4 and an upper camera 6 as an image shooting section, a sensor 8, a controller 10, and an information processor 12 as a calculating section. The sensor 8 includes a light emitter 14 and a light receiver 16.

The front face camera 4 is located in front of a swinging golf player. The front face camera 4 is arranged at a position and in a direction so that it can shoot an image of a swing from the front-side of the golf player. The upper camera 6 is located above a position where a ball 34 is placed. The upper camera 6 is arranged at a position and in a direction so that it can shoot an image of a swing from above the golf player. As the front face camera 4 and the upper camera 6, a CCD camera is exemplified. The front face camera 4 and the upper camera 6 are exemplified. A camera capable of shooting from the front or a camera capable of shooting from the back may be further included. A camera capable of shooting from the front or the back may be provided in place of the front face camera 4 or the upper camera 6.

The light emitter 14 of the sensor 8 is located in front of a swinging golf player. The light receiver 16 is located at the feet of the swinging golf player. The light emitter 14 and the light receiver 16 are arranged at positions between which a golf club to be swung passes. The sensor 8 can detect a head or a shaft of the passing golf club. The sensor 8 may be arranged in the front or the back, as far as it is arranged at a position where it can detect the head or the shaft. The sensor 8 is not limited to one including the light emitter 14 and the light receiver 16. The sensor 8 may be of a reflection type.

The controller 10 is connected to the front face camera 4, the upper camera 6, the sensor 8, and the information processor 12. The controller 10 can transmit a shooting start signal and a shooting stop signal to the front face camera 4 and the upper camera 6. The controller 10 can receive a swing image signal from the front face camera 4 and the upper camera 6. The controller 10 can receive a detection signal of the head or the shaft from the sensor 8. The controller 10 can output to the information processor 12 the swing image signal and the head or shaft detection signal.

Figure 2:
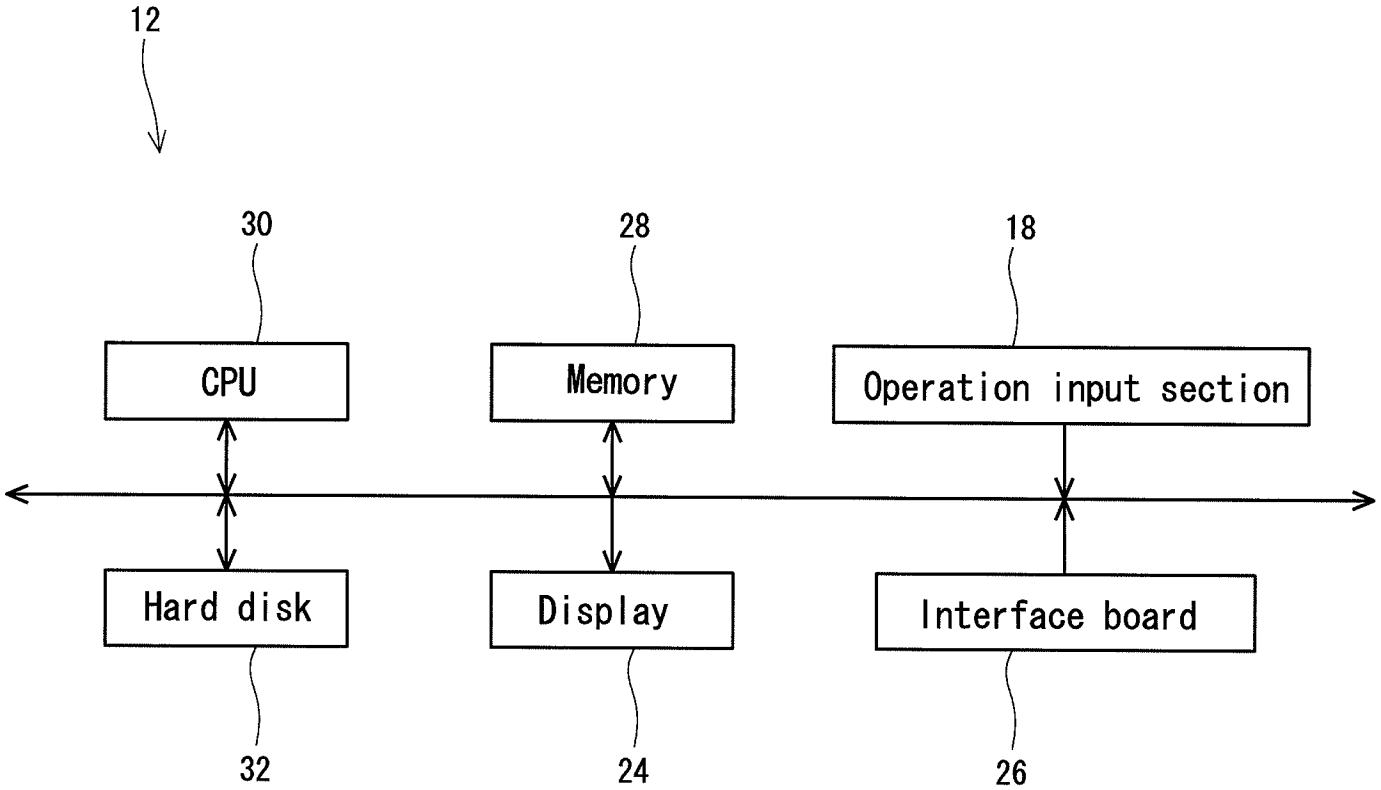
FIG. 2 is an illustration showing a system configuration of an information processor which constitutes the fitting device of FIG. 1.

As shown in FIG. 1 and FIG. 2, the information processor 12 includes a keyboard 20 and a mouse 22 as an information input section 18, a display 24 as an output section, an interface board 26 as a data input section, a memory 28, a CPU 30, and a hard disk 32. For the information processor 12, a general-purpose computer may be directly used.

The display 24 is controlled by the CPU 30. The display 24 displays various types of information. The output section may be any one as far as it displays fitting information such as a fit head or golf club, or swing measurement data or the like. The output section is not limited to the display 24, and a printer, for example, may be used.

To the interface board 26 are input swing image signals and head or shaft detection signals or the like. Measurement data is acquired from the image signals or detection signals. The measurement data is output to the CPU 30.

The memory 28 is a rewritable memory. The hard disk 32 stores a program or data or the like. For example, values of a plurality of head physical properties are stored as a database. Specifically, for example, data or expressions or the like representative of a relationship of an indicator and hitting result for each value of the physical properties are stored. The memory 28 constitutes a storage area or a working area or the like for the programs or the measurement data read from the hard disk 32.

The CPU 30 can read a program stored in the hard disk 32. The CPU 30 can run the program in the working area of the memory 28. The CPU 30 can execute various processes in accordance with the program.

Figure 3:
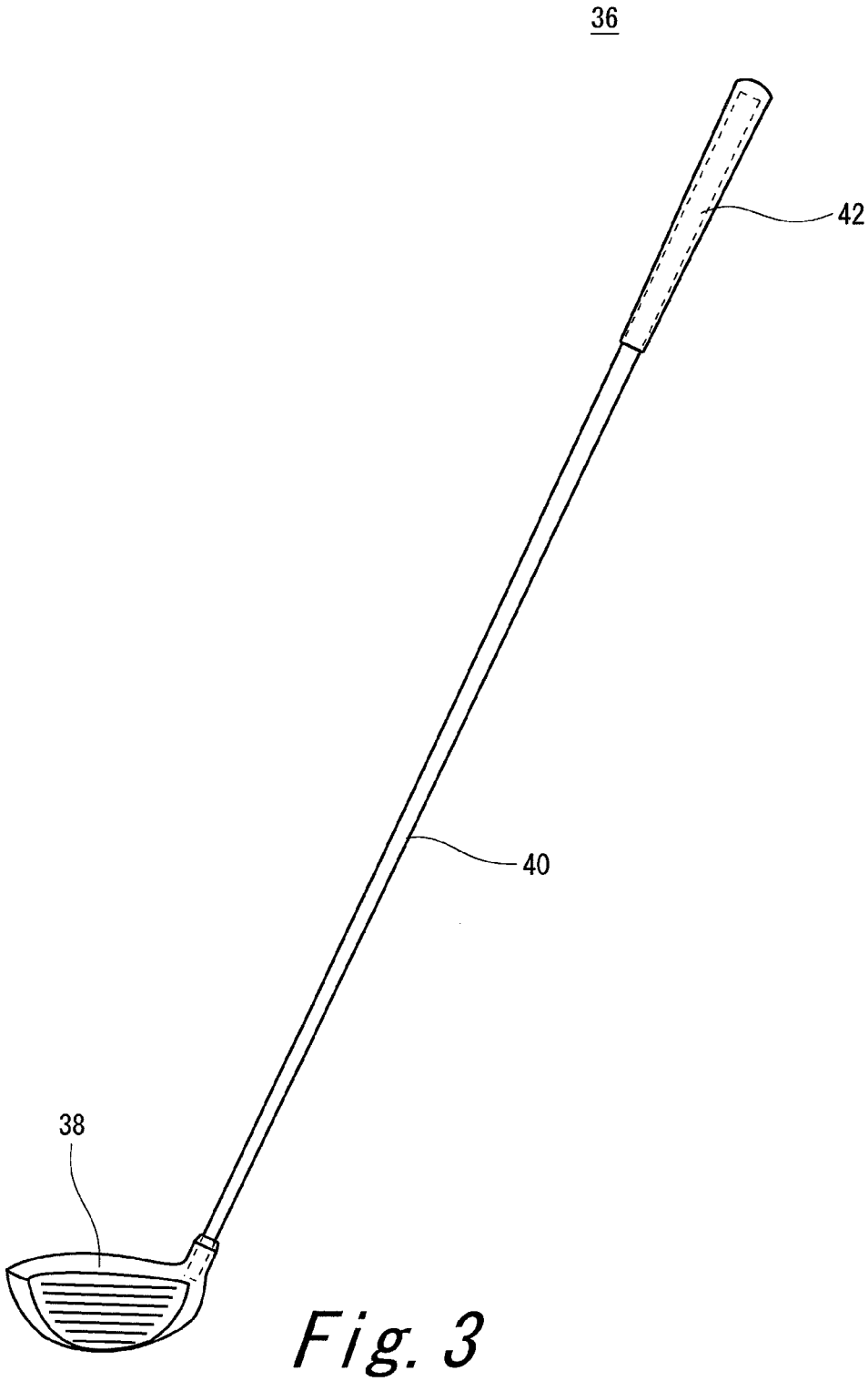
FIG. 3 is a front view of a golf club used in the fitting device of FIG. 1.

A golf club 36 shown in FIG. 3 is an example of a golf club used in the fitting device 2. A golf club used in fitting is called a test club. The golf club 36 is an example of a test club. The golf club 36 includes a head 38, a shaft 40, and a grip 42.

Figure 4A:
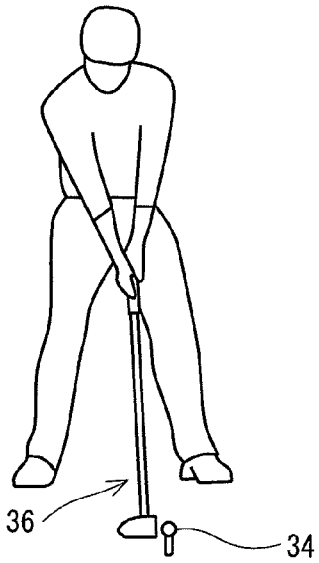
FIGS. 4A to 4D are illustrations of swing positions.
Figure 4B:
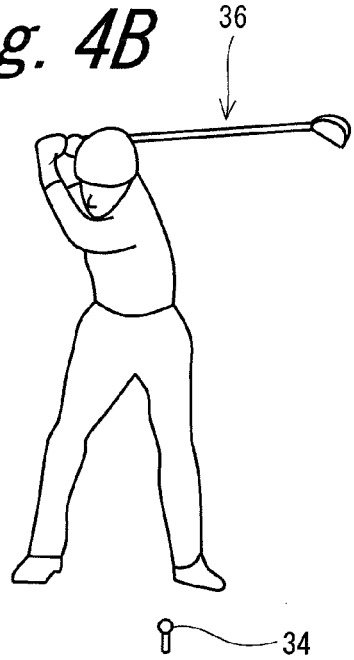
Figure 4C:
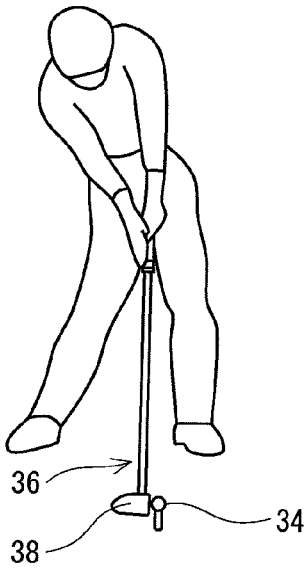
Figure 4D:
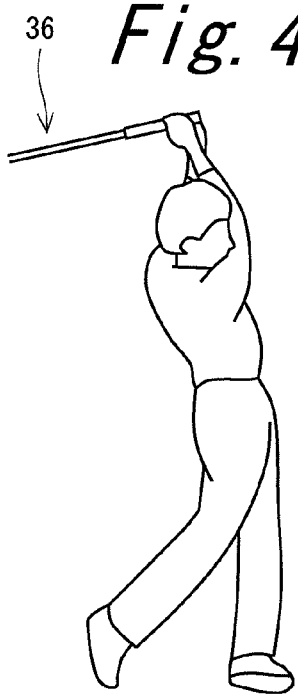

FIGS. 4A to 4D show respective positions at which a golf player swings with the golf club 36. A position in FIG. 4A is an address. A position in FIG. 4B is a top of swing (hereinafter referred to as a top). A position in FIG. 4C is an impact. An impact is a position at the moment when the head 38 and the ball 34 collide. A position in FIG. 4D is a finish. A golf player's swing sequentially shifts from the address to the top, from the top to the impact, and from the impact to the finish. The swing ends at the finish.

Figure 5:
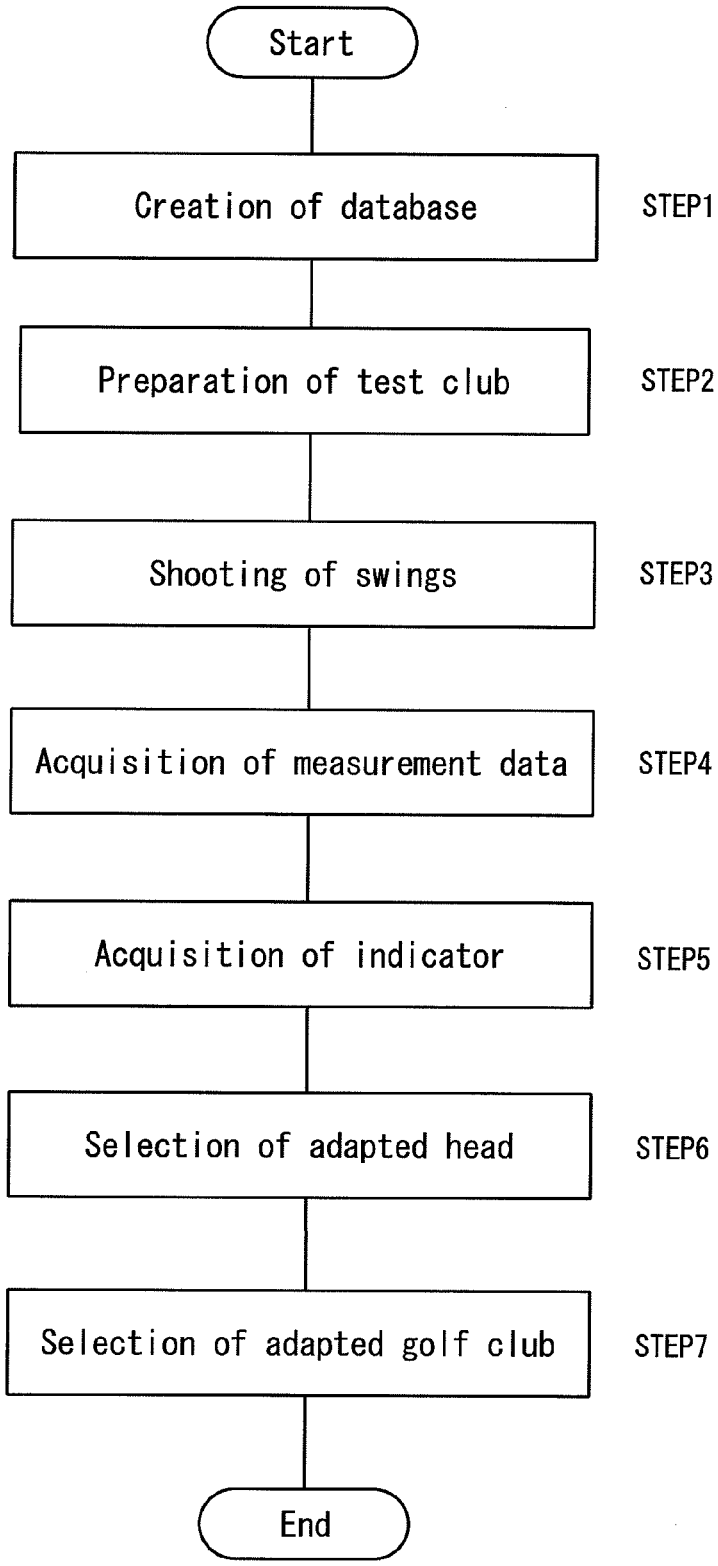
FIG. 5 is a flow chart showing one example of a fitting method according to the present invention.

FIG. 5 shows an example of a procedure of a fitting method of a golf club, according to the present invention. As a hitting result to be used in the fitting method, a ball flight distance or a ball direction (flying ball direction) is exemplified. As the ball direction, a right/left direction, an up/down direction, and a three-dimensional direction are exemplified. With reference to FIG. 5, a description will be given, exemplifying a flight distance of the ball 34 as a hitting result. The description will be given, exemplifying a centroid position of the head as a head physical property. As the centroid position, a position in a toe/heel direction, a position in a face/back direction, and a position in the up/down direction or the like are exemplified. In the embodiment, the toe/heel direction is used. In the embodiment, as an indicator and a characteristic value, a face angle before or at impact is used. Expression before impact refers to when a centerline of a tee and a face surface of the head 38 are at a predetermined distance which has been defined in advance. In the example, the expression before impact refers to when a distance between the tee centerline and the face surface of the head 38 is 3 cm. If the tee is not used, a vertical line passing through the center of the ball 34 may be used instead of the tee centerline. Preferably, the expression before impact refers to when a distance between the vertical line passing through the center of the ball and the face surface is within 10 cm, and more preferably, within 5 cm.

Preferably, a face angle is orientation of the face at a hitting point. If a bulge has been add to the face, the orientation of the face is preferably determined based on a tangent line at the hitting point. Although a hitting point is not yet fixed before impact, it can be predicted based on a path of the head or the like.

If an image at impact can be obtained, a face angle can be measured from the image. However, in some cases, it is difficult to obtain an image at impact. From the standpoint of easiness in measurement, as described above, it is better to measure a face angle before impact.

A face angle is measured based on an image of the face surface. However, an image of a marker provided on a crown may be used, instead of the image of the face surface. For example, the marker is a line along a boundary line of a crown section and the face surface. Another example of the marker is two or more points along the boundary line of the crown section and the face surface. In an image shot from above with the camera, a face angle is calculated based on an image of the marker.

In the information processor 12 of FIG. 1, a database of values of centroid positions of the head, a flight distance, and a face angle before impact has been created. Data in the database is acquired with an analysis method to be described below. This is a database creation step (STEP 1). Information identifying the head 38 and the shaft 40 is input into the information processor 12. Alternatively, the information identifying the head 38 and the shaft 40 may be input from the keyboard 20 during fitting. The information identifying the head 38 or the shaft 40 may be selected with the mouse 22 from multiple pieces of information appearing on the display 24.

The golf club 36 of FIG. 3 is prepared. This is a test club preparation step (STEP 2). A value of a centroid position of the head 38 of the golf club 36 in the toe/heel direction is 0 mm, for example. A centroid position of the head 38 is not limited. For example, a centroid position of the head 38 in the toe/heel direction may be more on the toe side than a face center or may be more on the heel side than the face center.

Swing images of a golf player are shot. This is a swing shooting step (STEP 3). A golf player takes an address position in the fitting device 2. The golf player swings. The golf player hits the ball 34 with the golf club 36. When the golf player shifts from the top to the impact, the sensor 8 detects the head 38 or the shaft 40. The detection signal is output to the controller 10.

The controller 10 outputs the detection signal and a swing image signal to the information processor 12. The information processor 12 acquires measurement data from the signals. This is a measurement data acquisition step (STEP 4).

In the step (STEP 4), multiple swing image signals may be extracted. Each of the multiple swing image signals may be converted into measurement data. The controller 12 may determine measurement data to be used in fitting, from multiple pieces of measurement data, on the basis of information identifying an image.

The information processor 12 calculates a value of the face angle from the measurement data. This is an indicator acquisition step (STEP 5). A method for determining the indicator will be described hereinafter. In the fitting method, the (STEP 2) to (STEP 5) constitute the steps of obtaining measurement result of a face angle when a subject (golf player) hits a ball with a test club.

As the indicator, in addition to a face angle before or at impact, speed of the ball 34, a spin rate of the ball 34, a spin orientation of the ball 34, an initial-launch angle of the ball 34 (up/down direction, right/left direction), a hitting position (up/down direction, toe/heel direction), head speed of a golf club, an attack angle of the head 38 (up/down direction, right/left direction), an effective loft angle before impact, a swing surface angle of a golf player, a shoulder twist angle, and a swing direction travel distance are exemplified. An indicator may also be obtained from measurement data such as movement of the ball 34, swing motion of a golf player or the like. The measurement data may be obtained from signals of the sensor.

The information processor 12 selects a fit head. This is a fit head selection step (STEP 6). In the selection step, a relational expression F1 is used. The relational expression F1 has been prepared in advance. The relational expression F1 is created based on the database described above. The method for creating the relational expression F1 will be described hereinafter.

In the selection step, based on the relational expression F1, a head is selected. In the embodiment, a centroid position of the head at which a flight distance is greatest is obtained from a face angle value obtained from the golf player. In the fitting method, a head physical property which is fitted to a subject is determined based on the relational expression F1 and measurement result of the face angle. As head physical properties, in addition to the centroid position, a lie angle, a bulge on the face surface, and a moment of inertia of the head are exemplified. As the moment of inertia, lateral moment of inertia and vertical moment of inertia are exemplified. In a head in a reference state in which it is placed on a horizontal surface with a predetermined lie angle and a loft angle, a vertical line passing through a center of gravity of the head is an axis Z1. The lateral moment of inertia means moment of inertia around the axis Z1.

The information processor 12 selects a golf club on the basis of values of head physical properties. This is a fit golf club selection step (STEP 7). On the display 24, information identifying a golf player and fitting information such as a face angle as an indicator and a fit golf club or the like are displayed. The information may be printed by a printer, although it is not shown, as the output section.

Based on the fit head physical properties, furthermore, the best fit head physical property may be determined. A plurality of golf clubs having the head whose centroid position is close to the centroid position of the head which is determined to fit and whose centroid positions of the head differ from each other are prepared. The golf clubs are test hit by a subject. From result of the test hitting, a centroid position of the head whose hitting result is best may be determined as an optimal centroid position.

In addition, a plurality of golf clubs which have the head physical property (centroid position of the head) determined to fit, and which are equipped with heads having other head physical properties (a lie angle, lateral moment of inertia or the like) which differ from each other may be prepared. The subject test hits with the golf clubs. From result of the test hitting, a head (golf club) with the best hitting result is determined to be an optimal head (golf club).

In the embodiment, the head physical property which is fitted to the subject is determined by using a relationship of a flight distance and a face angle before impact of the ball 34. The relational expression F1 is a relational expression F11 of the face angle before impact and the flight distance.

Next, a description will be given by way of example of a case in which hitting result to be used in the fitting method is a right/left direction in which a ball 34 flies (hereinafter simply referred to as a right/left deflection). Now, a configuration which is different from that of the fitting method described above will be mainly described. A description of a similar configuration will be omitted.

A right/left deflection is represented in degrees. When a ball is launched straight, a right/left deflection has an angle of 0 degree. When it is launched and deflects to the left direction, the angle is indicated in minus and magnitude of the deflection is indicated in degrees. When it is launched and deflects to the right direction, the angle is indicated in plus and magnitude of the deflection is indicated in degrees.

A method for measuring the right/left deflection is not limited. The right/left deflection may be measured based on an initial speed vector of a ball. A distance between a straight line connecting a target point with a ball hit point and a ball fall point may be the right/left deflection. A distance between the straight line connecting the target point with the ball hit point and a ball stopped point may be the right/left deflection.

In the information processor 12 of FIG. 1, a database is created. The database is multiple results of actual hitting of a golf player. The database contains values of centroid positions of the head, the right/left deflection, and the face angle before impact. This is a database creation step (STEP 1). Information identifying the head 38 and the shaft 40 is input in the information processor 12.

The golf club 36 of FIG. 3 is prepared. This is a test club preparation step (STEP 2). Swing images of a golf player are shot. This is a swing shooting step (STEP 3). The controller 10 outputs the detection signal and the swing image signal to the information processor 12. The information processor 12 acquires measurement data from the signals. This is a measurement data acquisition step (STEP 4). The information processor 12 calculates a value of the face angle from the measurement data. This is an indicator acquisition step (STEP 5).

The information processor 12 selects a fit head. This is a fit head selection step (STEP 6). With an analysis method to be described later, a relationship of a right/left deflection of the ball 34, values of centroid positions of the head, and a face angle has been determined in advance. Based on this relationship, the relational expression F1 (relational expression F11) of the right/left deflection and the face angle is stored for each value of the centroid positions of the head. Based on the relational expression F1, a value of the centroid position of the head with the smallest right/left deflection is determined from the value of the face angle obtained from the golf player. This centroid position of the head is the fit head physical property.

The information processor 12 selects a golf club having that head, based on the value of the head physical property. This is a fit golf club selection step (STEP 7). On the display 24, fitting information such as information identifying the golf player, the face angle as a value of the indicator, and the fit golf club or the like is displayed.

In the embodiment, the head physical property fitted to the subject is determined, using a relationship of the right/left direction in which the ball 34 flies and the face angle before impact. The relational expression F1 (relational expression F11) is a relational expression of the face angle before impact and the right/left direction in which the ball 34 flies.

Figure 6:
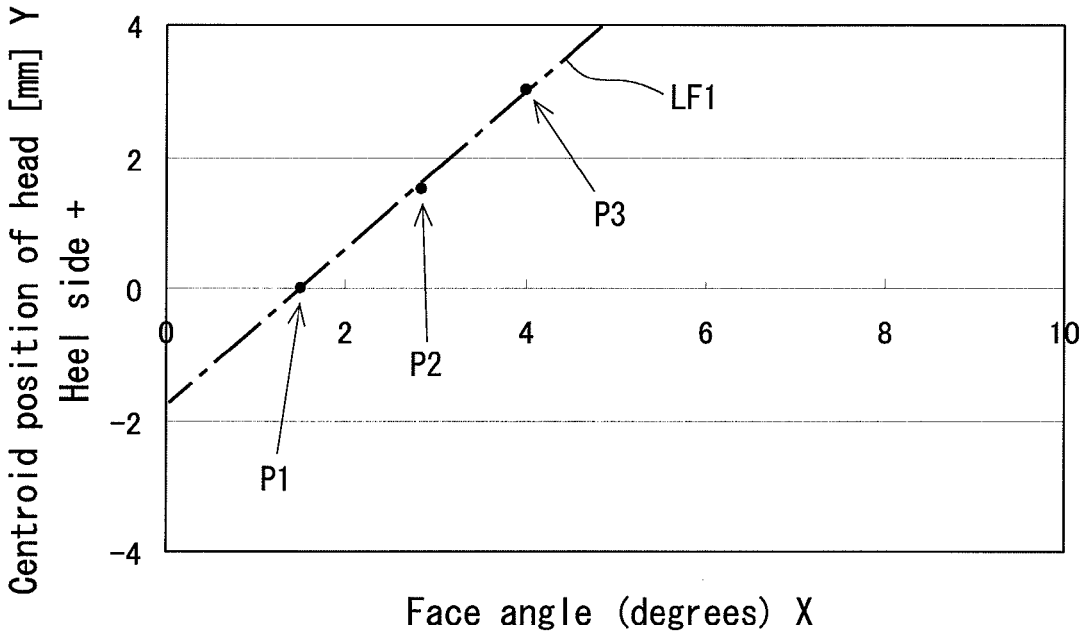
FIG. 6 is a graph showing a relationship of a centroid position of a head and a face angle when a right/left deflection is small.

FIG. 6 shows other example of the relational expression F1 to be used in a fit head selection step (STEP 6). A straight line LF1 of FIG. 6 shows a relational expression F1 (relational expression F12) of a face angle X and a centroid position of the head (toe/heel direction) for which a right/left deflection is smallest (the right/left deflection is 0 degree). A method for determining the relational expression F1 will be described below. When a linear expression is adopted, the relational expression F1 is represented by the following expression:

$$Y=A1\cdot X+B$$

(coefficient A1 and intercept B are a constant.)

A measured face angle is given as a value of the face angle X. The measured face angle is assigned and a value of a centroid position Y of the head is calculated. A head having a value of the centroid position which is closest to the measured value of the centroid position Y of the head is selected. A head may be custom made based on the value of the centroid position of the head.

In addition, as a relational expression F1 (relational expression F11) of a face angle and hitting result, a multiple regression equation may be used. In a multiple regression equation, one objective variable is represented by a plurality of explanatory variables. A multiple regression analysis reflects which explanatory variable and how much an explanatory variable affects an objective variable. As a plurality of explanatory variables is considered in a multiple regression expression, accuracy of fitting may be improved. A multiple regression equation is not limited, and a linear expression, a quadratic expression or the like are exemplified.

In addition, for example, as other relational expression F1 (relational expression F11), the following multiple regression equation is obtained from a flight distance ratio Y1 as a hitting result, a face angle X1 as an indicator, and a value X2 of a centroid position as a head physical property:

$$Y1=A2\cdot X1+A3\cdot X2+A4\cdot X1\cdot X2+B1$$

(coefficients A2, A3, A4 and intercept B1 are a constant.)

The relational expression F1 is determined from a relationship of a face angles before impact and flight distances of when a plurality of golf players swing using a plurality of golf clubs with different centroid positions of heads. For example, values of the centroid positions of the heads are three types: a position on a toe side, a center position, and a position on a heel side.

The flight distance ratio Y1 is determined, for example, based on a flight distance L of a club a centroid position of the head of which is at the center. The flight distance ratio Y1 of the club (center) is L/L, and 1. A flight distance ratio Y1 of a flight distance La of a club a centroid position of which is on the heel side is determined as La/L. A flight distance ratio Y1 of a flight distance Lb of a club a centroid position of which is on the toe side is determined as Lb/L. The coefficients A2, A3, A4, and the intercept B1 can be determined from a relationship of the head physical properties, the face angles, and the flight distances (flight distance ratios).

A subject hits a ball with the golf club having the head with the centroid position at the center, as a test club, and then a measurement result of a face angle is obtained. Based on the relational expression F1 and the measurement result, a flight distance ratio Y1 is determined at each of the three types of centroid positions of the head. A value of the head physical property when the flight distance ratio Y1 is greatest is considered a head physical property fitted to the subject.

Figure 7:
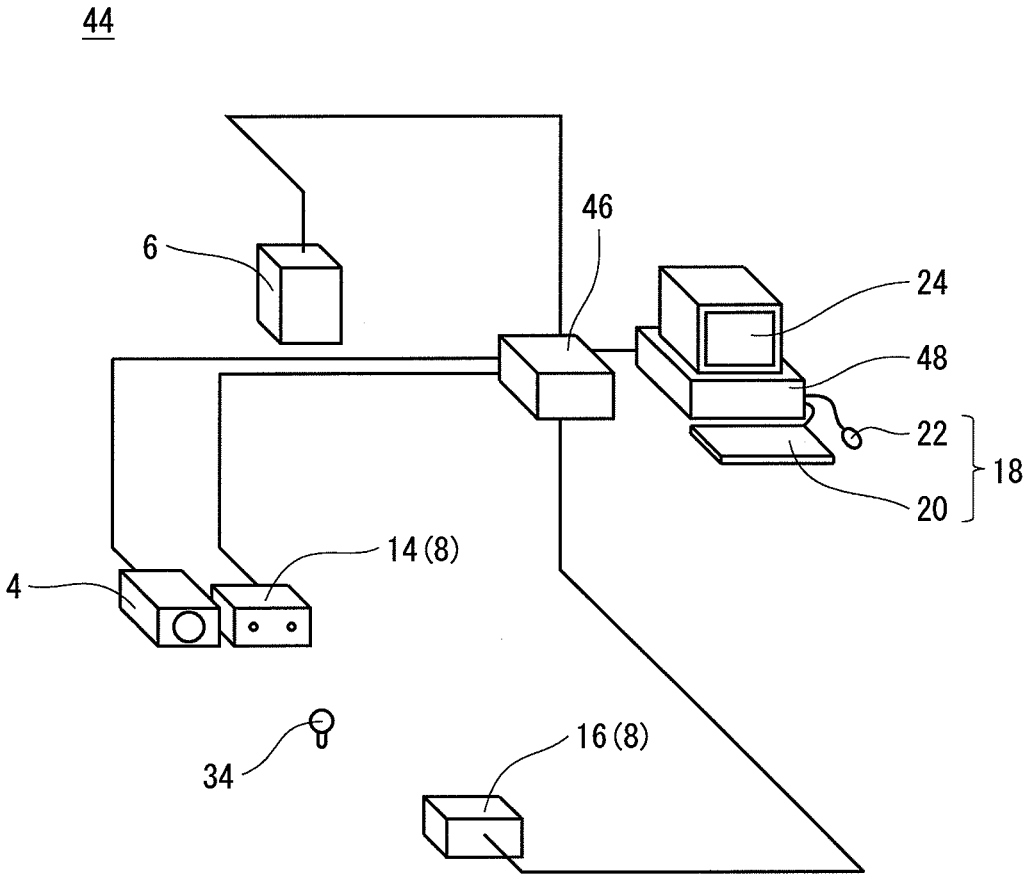
FIG. 7 is a schematic view showing a configuration of a swing analyzer of an embodiment according to the present invention.

FIG. 7 shows a swing analyzer 44. The swing analyzer 44 includes a front face camera 4, an upper camera 6, a sensor 8, a controller 46, and an information processor 48 as a calculating section. Similar to those in the fitting device 2, a description of the front face camera 4, the upper camera 6, and the sensor 8 will be omitted.

Similar to the controller 10, the controller 46 controls the front face camera 4 and the upper camera 6. Similar to the controller 10, the controller 46 receives a detection signal of a head 38 or a shaft 40 from the sensor 8. The controller 10 may also be used as the controller 46.

Similar to the information processor 12, the information processor 48 includes a keyboard 20 and a mouse 22 as an information input section 18, a display 24 as an output section, an interface board 26 as a data input section, a memory 28, a CPU 30, and a hard disk 32. For the information processor 48, a general-purpose computer may be used directly. The information processor 12 may also be used as the information processor 48.

Figure 8:
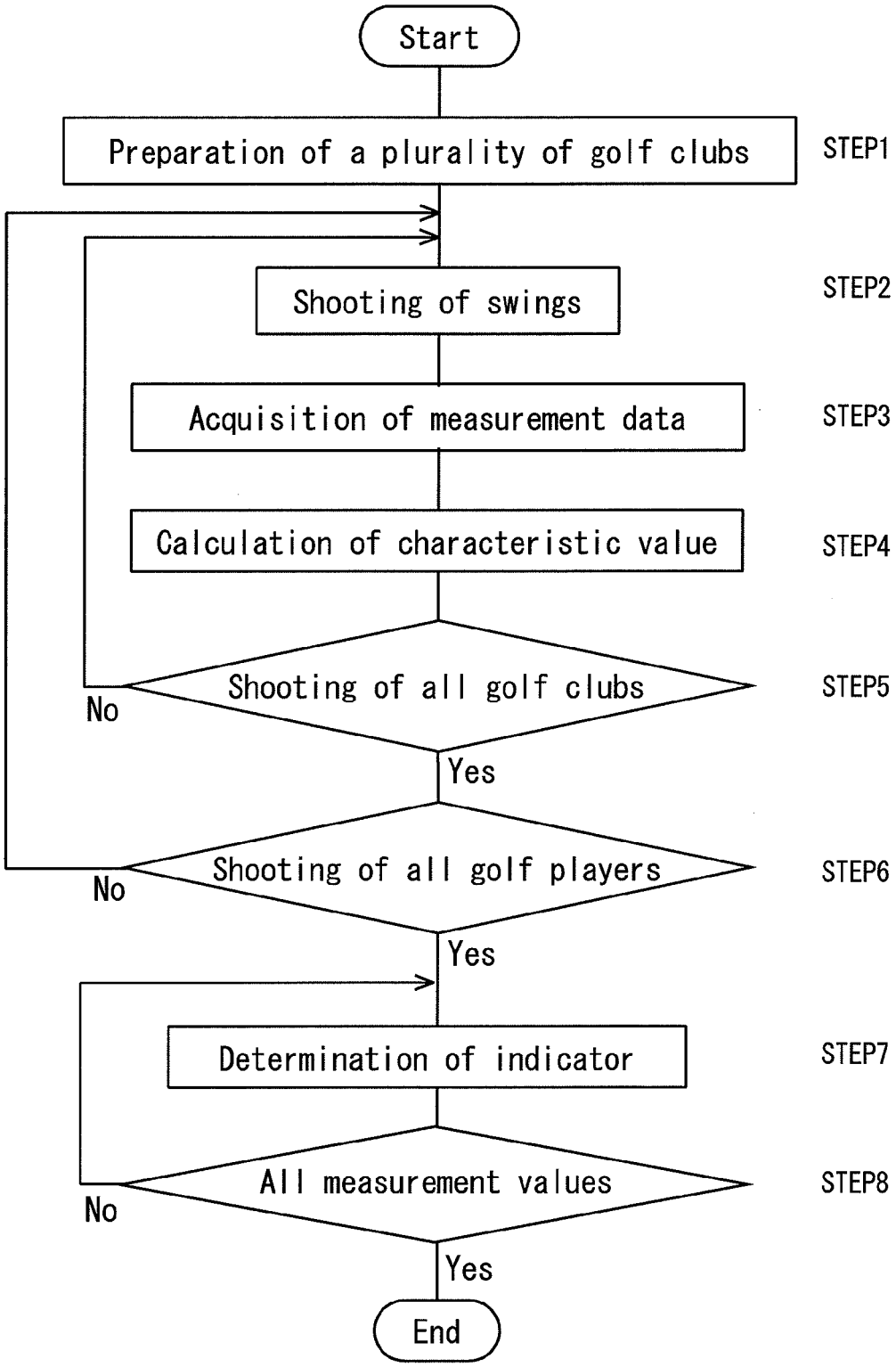
FIG. 8 is a flow chart showing one example of an analysis method according to the present invention.

FIG. 8 shows a procedure of one example of an analysis method of fitting of a golf club according to the present invention. In the analysis method here, with a flight distance of a ball 34 as a hitting result, an indicator for determining a value of a centroid position of a fit head is determined.

In this method, a plurality of golf clubs with different values of centroid positions of heads is prepared (STEP 1). Specifically, a golf club 36 to which a head 38 whose centroid is at the center is attached, a golf club A to which a head 38 whose centroid is on the heel is attached, and a golf club B to which a head 38 whose centroid is on the toe is attached are prepared. Although the three types of golf clubs are prepared here, the number of types of golf clubs may be 2 types, 4 types, or 5 types. Any number of types of golf clubs may be accepted as far as it is more than two types.

Swing images of golf players with the plurality of golf clubs are shot. This is a swing shooting step (STEP 2). Flight distances of the balls 34 of the swings are measured.

The controller 46 outputs the swing image signals to the information processor 48. The information processor 48 acquires measurement data on the basis of the image signals. Flight distance data of the balls 34 is input into the information processor 48 through the information input section 18, such as the keyboard 20, for example. The information processor 48 stores the flight distance data of the ball 34 corresponding to the measurement data. This is a measurement data acquisition step (STEP 3).

The information processor 48 calculates a characteristic value from the stored measurement data (STEP 4). The characteristic value is associated with each measurement data and stored. As the characteristic value, a face angle before impact, speed of the ball 34, a spin rate of the ball 34, a spin orientation of the ball 34, an initial-launch angle of the ball 34 (right/left direction), an initial-launch angle of the ball 34 (up/down direction), a hitting position (up/down direction), a hitting position (toe/heel direction), head speed of a golf club, an attack angle of the head 38, a blow angle, a face angle before impact, a loft angle of the head 38, a swing plane angle of a golf player, a shoulder twist angle, and a swing direction travel distance are exemplified.

A golf player swings N times (N is a natural number of 1 or greater). A golf player hits the ball 34 with the golf club 36 N times. Images of swings to be made N times with the golf club 36 are shot. A characteristic value obtained from the images of N swings is determined. Here, the golf club 36 is made a test club. The characteristic value is calculated from multiple pieces of measurement data acquired with the golf club 36. For example, the characteristic value is calculated from an average value of measurement data to be obtained from data of measurements which are made N times. For every golf player, a flight distance as an average of N flight distances with the golf club 36 is determined.

Similarly, the process from (STEP 2) to (STEP 4) is repeated with a golf club A and a golf club B (STEP 5). Furthermore, the process from (STEP 2) to (STEP 5) is similarly repeated by a plurality of golf players (STEP 6). In this manner, measurement data and characteristic values are obtained from images of swings of a plurality of golf players. Golfers who make swings are advanced players who can repeat almost constant swings.

The information processor 48 stores values of the head physical properties, characteristic values, and flight distances of the ball 34 in a database. The information processor 48 extracts any characteristic value from the stored characteristic values.

When the flight distance of the ball 34 is made an objective variable, with the characteristic value and the value of the head physical properties as an explanatory variable, the information processor 48 judges whether the characteristic value and the flight distance have a statistically significant relation. If they have a statistically significant relation, the characteristic value can be determined as one of the indicators (STEP 7).

For example, an extracted characteristic value is a face angle before impact during a swing with the golf club 36, and a value of the head physical property is a head centroid position. Then, furthermore, with a flight distance ratio Y1, an average face angle X1, and a value X2 of a physical property, as an example of other relational expression F1, a function is determined by the multiple regression analysis. The following relational expression is determined by the method of least squares:

$$Y1=A2\cdot X1+A3\cdot X2+A4\cdot X1\cdot X2+B1$$

(coefficients A2, A3, A4, and intercept B1 are a constant.)

Here the flight distance ratio Y1 of each golf club to the flight distance L of the golf club 36 is determined. The flight distance ratio Y1 of the golf club 36 is 1. The flight distance ratio Y1 of the flight distance La of the golf club A is determined as La/L. The flight distance ratio Y1 of the flight distance Lb of the golf club B is determined as Lb/L. The flight distance ratio Y1 is made a vertical axis. This controls influence of a difference in a flight distance due to an individual difference.

A face angle which is judged to have a statistically significant relation from the relational expression F1 is determined to be one indicator. The indicator is stored in the information processor 12. Similarly, it is judged whether or not all the characteristic values determined in (STEP 4) fall under indicators (STEP 8). In this manner, a plurality of indicators is determined. The plurality of indicators is stored in the information processor 12.

The relational expression F1 (relational expression F11) to be determined from the multiple regression analysis may be determined as a linear function, as shown below:

$$Y1=A5\cdot X1+A6\cdot X2+B2$$

(coefficients A5, A6 and intercept B2 are a constant.)

Any indicator can be selected from the plurality of indicators. With the selected indicator, fitting of a golf club can be performed. Fitting of a golf club may be performed by combining a plurality of indicators from these indicators.

Use of a characteristic value having a statistically significant relation as an indicator enables the fitting method to achieve fitting which improves hitting results. Use of the indicator enables the fitting device 2 to achieve fitting which easily improves hitting results. In the fitting method and the fitting device 2, fitting of a golf club is performed objectively.

In the fitting method and the fitting device 2, fitting is performed with a plurality of heads with different values of predetermined physical properties. The values of the physical properties have been defined in advance and measured with a predetermined method. The fitting method is not influenced by standards which differ depending on a manufacturer.

Here, the identified head 38 is used. With this, fitting for a golf player is performed with a combination of the head and the shaft 40. The analysis method according to the present invention may be applied to other types of heads. With the fitting method using the indicator, fitting of a combination of any identified head with the best fit shaft can be performed.

Figure 9:
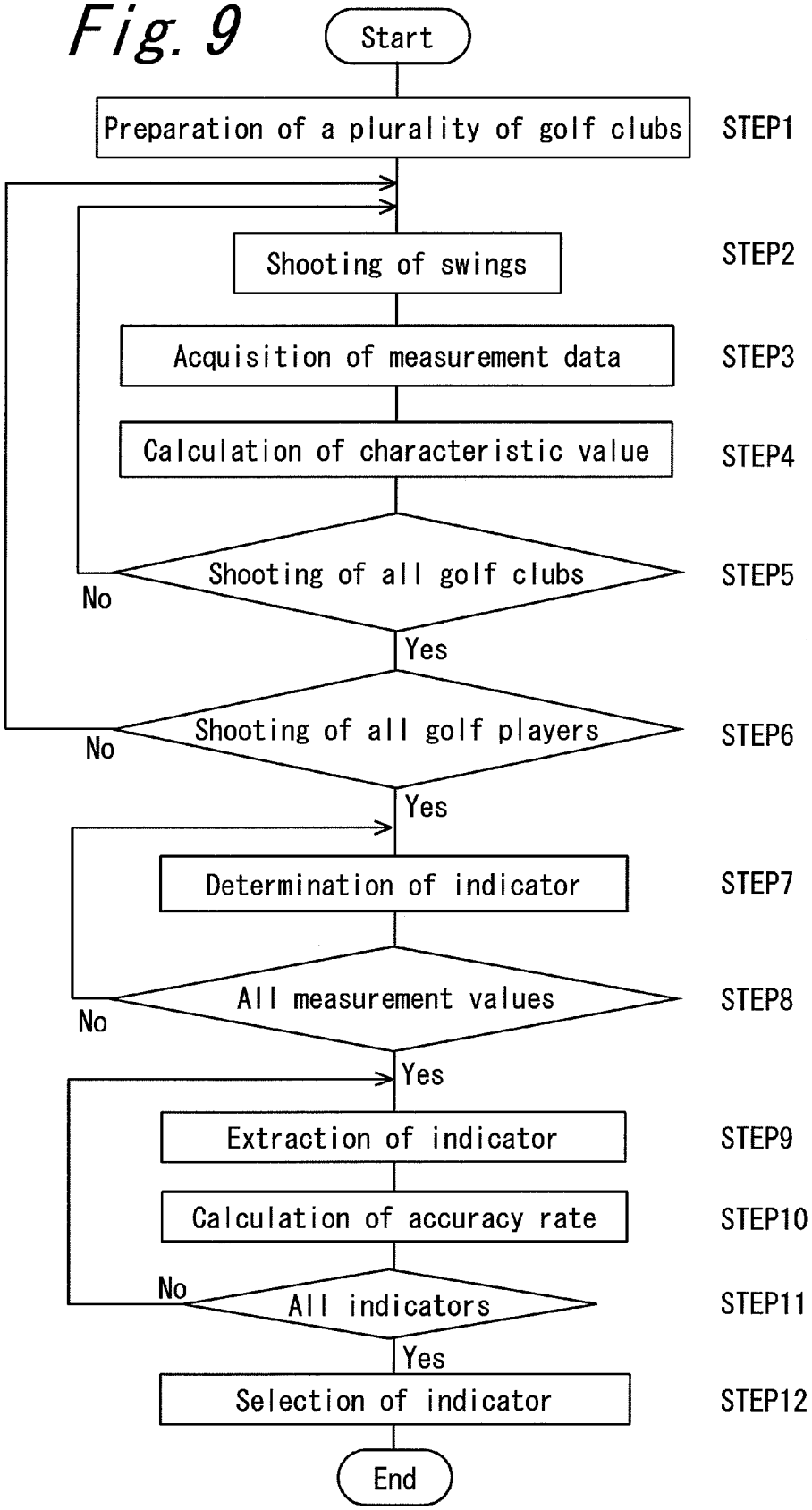
FIG. 9 is a flow chart showing other example of the analysis method according to the present invention.

FIG. 9 shows other example of the analysis method of fitting according to the present invention. (STEP 1) to (STEP 8) of the analysis method are identical to the analysis method shown in FIG. 8, and its description is omitted. A configuration different from that of the analysis method shown in FIG. 8 will be described.

Any one indicator is extracted (STEP 9) from the plurality of indicators determined with the procedure (STEP 7) shown in FIG. 8.

An accuracy rate of the physical property determined from the indicator is calculated (STEP 10). Specifically, for the extracted indicator, a value Xa (n) of a head physical property fitted to each golf player is selected (n is a natural number corresponding to each golf player). The value Xa (n) of the physical property is selected based on a relational expression F1.

For each golf player, a value Xb (n) (n is a natural number corresponding to each golf player) of a head physical property of a golf club with the greatest flight distance average is read from stored flight distance data. For each golf player, the physical property value Xa (n) is compared with the physical property value Xb (n). When the physical property value Xa (n) and the physical property value Xb (n) match, it is judged as a correct answer. As an accuracy rate of the judgment, a rate judged as a right answer for selection result of all golf players is determined.

Similarly, all accuracy rates of the plurality of indicators determined in (STEP 7) are determined (STEP 11). An indicator with the highest accuracy rate among accuracy rates of all the indicators is selected. The indicator is selected to be an indicator to be used in fitting of a golf club (STEP 12). In addition, in the selection of the indicator (STEP 12), a plurality of combinations of indicators is selected, and a case in which one of the indicators is the indicator with the highest accuracy rate is included.

Through the use of the indicator obtained by the analysis method of FIG. 9, an accuracy rate of fitting can be improved as compared with the case where the indicator by the analysis method of FIG. 8 is used. The analysis method can improve the accuracy in fitting of a fit head. The analysis method can improve the accuracy in fitting of a combination of a shaft and a head.

Figure 10:
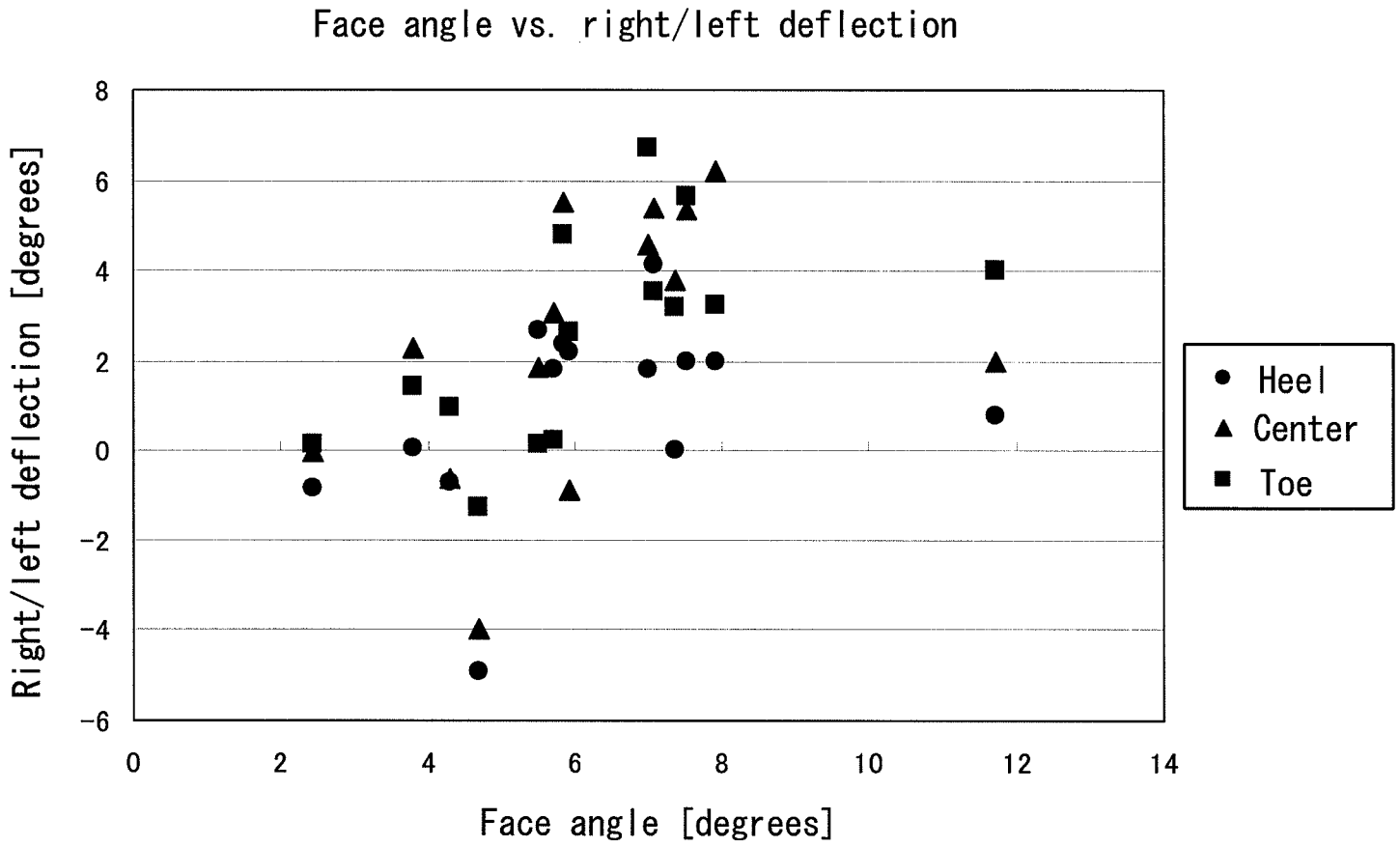
FIG. 10 is a graph showing a relationship of a deflection between right or left which is a direction in which a ball flies and a face angle.

FIG. 10 shows a right/left deflection of a ball when a plurality of golf players hit a ball with a head whose centroid is on the heel, a head whose centroid is at the center, and a head whose centroid is on the toe. In FIG. 10, the golf players are identified by magnitude of a face angle. Points of the golf club having the greatest flight distance for each face angle are shown larger than points of the other golf clubs. For each golf player (face angle), when the greatest flight distance is reached, a right/left deflection tends to become smaller than heads with other centroid positions. For the golf club with the greatest flight distance, points are distributed so that the right/left deflection approximates to 0.

In the embodiment, a centroid position in the toe/heel direction is adopted as a head physical property. In the embodiment, the centroid position of the head whose centroid is on the heel is 3.0 mm, the centroid position of the head whose centroid is at the center is 1.5 mm, and the centroid position of the head whose centroid is on the toe is 0 mm. The centroid positions are the centroid positions in the toe/heel direction. When these centroid positions are indicated, those on the heel side are indicated as a plus, those on the toe side are indicated as a minus, and the face center is 0 mm. The greater a numeric value is, more on the heel side the centroid position is.

Figure 11:
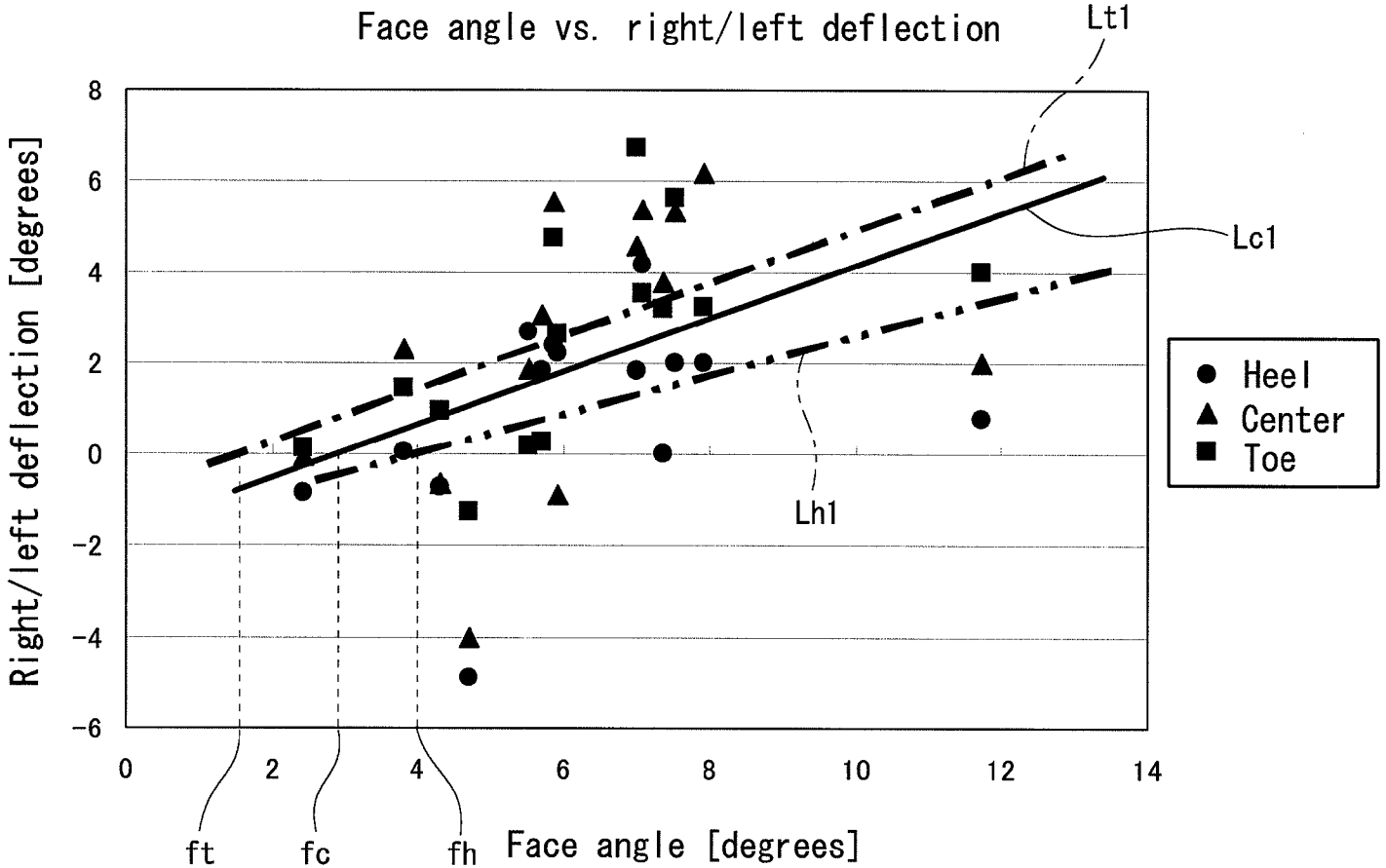
FIG. 11 is a graph showing a relationship of a right/left deflection and a face angle for each value of a centroid position of a head.

FIG. 11 is obtained from the data of FIG. 10. For each head, a relational expression F1 (relational expression F11) of the face angle and the right/left deflection is determined. The relational expressions F1 are determined by regression analysis, using the least-square method. The relational expressions F1 are a straight line Lt1, a straight line Lc1, and a straight line Lh1. The relational expressions F1 are represented by the straight line Lt1, the straight line Lc1, and the straight line Lh1. The straight line Lt1 is determined by the least-square method, on the basis of data of the head whose centroid position is on the toe side. The straight line Lc1 is determined by the least-square method, on the basis of data of the head whose centroid position is at the center. The straight line Lh1 is determined by the least-square method, on the basis of data of the head whose centroid position is on the heel side. A value of the centroid position of the head with the smallest right/left deflection to the face angle of the golf player can be determined based on these relational expressions F1.

As FIG. 11 shows, a value ft is a value of the straight line Lt1 when the right/left deflection is 0 degree. A value fc is a value of the straight line Lc1 when the right/left deflection is 0 degree. A value fh is a value of the straight line Lh1 when the right/left deflection is 0 degree.

In addition, in the embodiment, although the centroid positions of the heads are termed the toe side, the heel side, and the center, they are simply relative terms. For example, "center" used herein does not always mean a face center.

Figure 12:
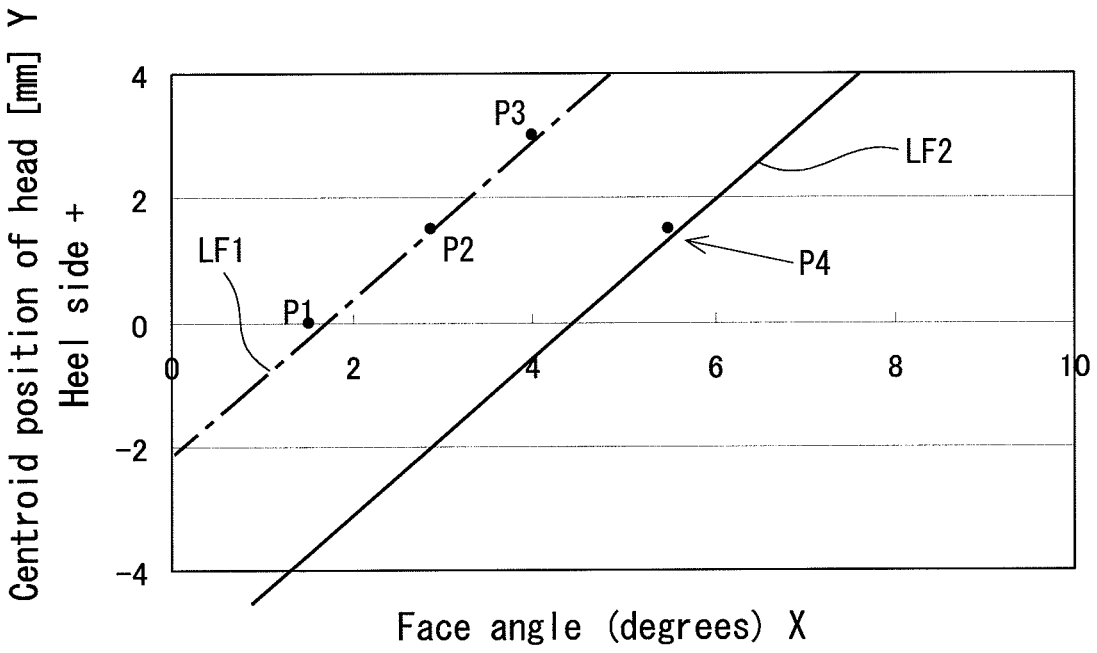
FIG. 12 is a graph showing other relationship of a centroid position of a head and a face angle when a right/left deflection is small.

Now, a method for determining the straight line LF1 shown in FIG. 6 will be described. The straight line LF1 is also shown in FIG. 12. Point P1 in FIG. 6 shows a combination of the centroid position of the head whose centroid is on the toe and the face angle when the angle of the right/left deflection is 0 degree. Coordinates of the point P1 is (ft, 0). Similarly, point P2 shows a combination of the centroid position of the head whose centroid is at the center and the face angle when the angle of the right/left deflection is 0 degree. Coordinates of the point P2 is (fc, 1.5). Similarly, point P3 shows a combination of the centroid position of the head whose centroid is on the heel and the face angle when the angle of the right/left deflection is 0 degree. Coordinates of the point P3 is (fh, 3.0). As an approximate linear function expression passing through the points P1, P2, and P3, the straight line LF1 is determined. Here, the straight line LF1 is determined by the least-square method from these three points.

The straight line LF1 is shown by the following approximate linear expression when a value of the head physical property is Y and a value of the face angle is X.

$$Y=A1\cdot X+B$$

(coefficient A1 and intercept B are a constant.)

With the relational expression F1, a value of the centroid position Y of the fit head can be calculated from a face angle X to be measured.

Figure 13:
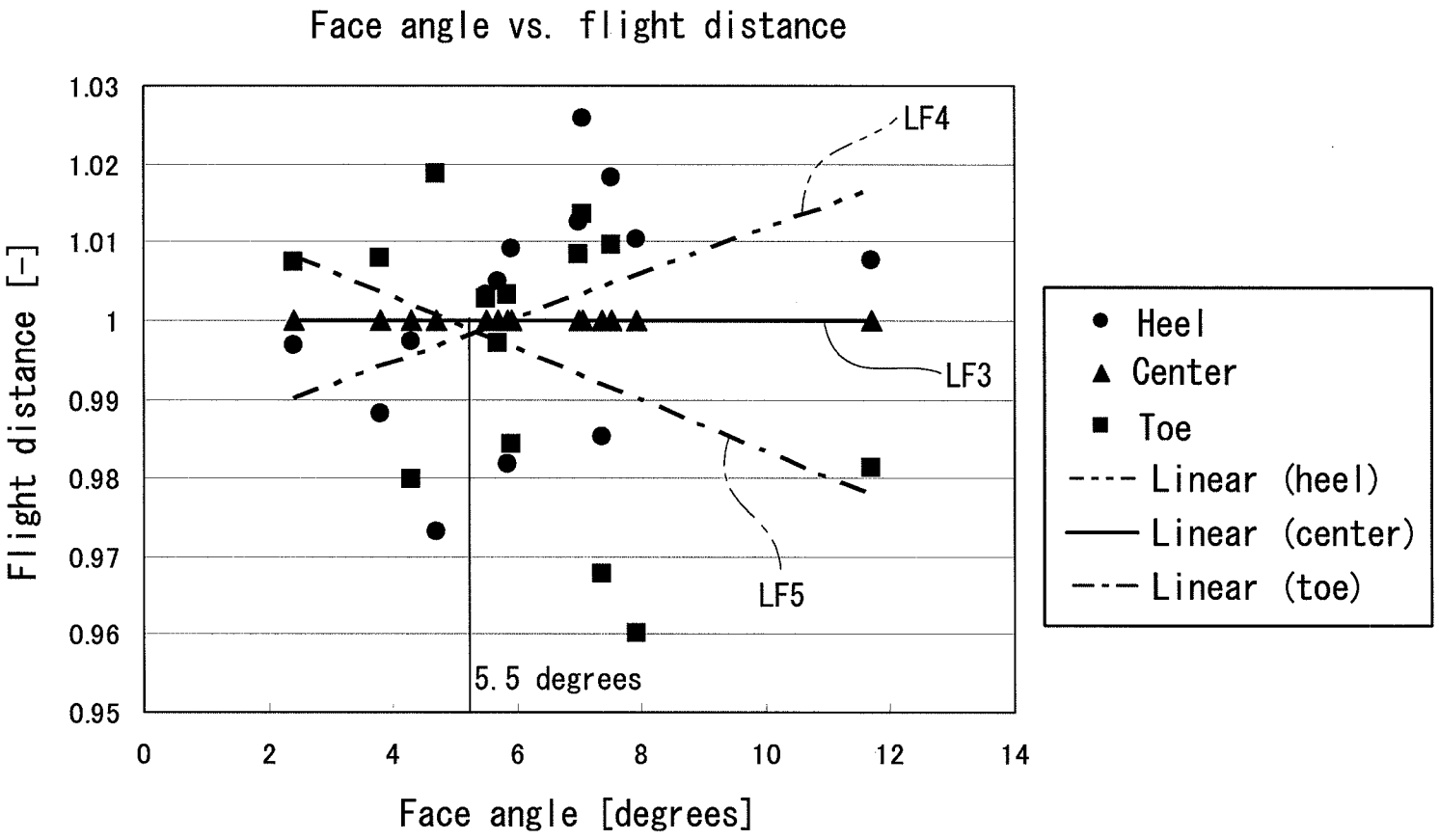
FIG. 13 is a graph showing a relationship of a face angle and a flight distance rate for each value of a centroid position of a head.

Next, an analysis method with a combination of a right/left deflection and a flight distance ratio as a hitting result is exemplified. Using FIG. 12 and FIG. 13, a method for modifying the straight line FL1 determined from the right/left deflection on the basis of a relationship of the flight distance ratio and the face angle will be described. In FIG. 13, the above-mentioned relational expression F1 (relational expression F11) of the flight distance ratio and the face angle is determined for each value of the centroid positions of the heads. These relational expressions F1 are determined by the regression analysis with the least-square method. Based on FIG. 13, in the head whose centroid is at the center, a range of face angles which enables favorable flight distances to be obtained is determined. As the range of face angles, in the graph of FIG. 13, a range in which the flight distance of the head whose centroid is at the center is larger than the flight distance of the head with other centroids is adopted. As seen from FIG. 13, a median of the range of the face angles for which the head having the centroid at the center is suitable is 5.5 degrees.

In FIG. 12, the straight line LF2 is determined from the straight line LF1. The straight line LF2 has a same inclination A1 as the straight line LF1. The straight line LF2 is a straight line passing through point P4 and having the inclination A1. Coordinates of the point P4 are (5.5, 1.5). In other words, here, the value of the intercept B of the straight line LF1 is modified so that it passes through the point P4. The straight line LF2 may be used as the relational expression F1, instead of the straight line LF1.

When the linear expression is adopted as described above, one example of the relational expression F1 is as follows:

$$Y=A1\cdot X+B$$

Preferably, the above-mentioned A1 is a positive value. In other words, preferably, the relational expression F1 is a relational expression in which the greater the face angle X is, the more on the heel side the recommended centroid position Y of the head is. This means that the greater the face angle X is, the more open the face angle is. In the case of a right-handed golf player, a positive face angle X means that the face is facing to the right, and a negative face angle means that the face is facing to the left.

In addition, the relational expression F1 is not limited to a linear expression, and a quadratic or polynomial expression may be listed. An approximate expression is not limited to a linear expression, and a quadratic or polynomial expression may be listed.

A fitting method by combining two hitting results will be exemplified hereinafter. As compared with a case in which one hitting result is used, the fitting accuracy can be better by using two hitting results. Here, as two hitting results, a ball direction and a flight distance are used. In the embodiment, as a ball direction, a right/left deflection is used. In the embodiment, as a flight distance, a flight distance ratio is used. The flight distance ratio is a relative value of the flight distance. An absolute value of the flight distance may be used instead of the flight distance ratio. Typically, an absolute value of the flight distance is expressed in yard or meter.

In the embodiment, a relational expression F1 (straight line LF1) based on a first hitting result is modified based on a second hitting result. The modification will be described using FIG. 12 and FIG. 13 which were described above. Here, a right/left deflection is adopted as a first hitting result, and a flight distance ratio is adopted as a second hitting result.

First, as described above, based on the right/left deflection (first hitting result), the straight line LF1 (relational expression F1) is determined. Then, based on the fight distance ratio (second hitting result), the straight line LF1 is modified. The modification is based on correlation Rx of the flight distance ratio and the face angle.

FIG. 13 is a graph showing the correlation Rx. In FIG. 13, the correlation Rx of the flight distance ratio and the face angle is determined for each head property (centroid position of a head). As the correlation Rx, three relational expressions are determined. The relational expressions are determined by the regression analysis with the least-square method.

Here, based on the correlation Rx, a range in which preferable results are obtained in the head having the centroid at the center is selected. As shown in FIG. 13, in the embodiment, for the head having the centroid at the center, particularly preferable results can be obtained when the face angle is near 5.5 degrees. In the range near 5.5 degrees, the head having the centroid at the center has a higher flight distance ratio than a head having the centroid on the heel and that having the centroid on the toe. In other words, in FIG. 13, when the face angle is between about 5 degrees and about 6 degrees, a straight line LF3 is above a straight line LF4 and a straight line LF5. For example, any value is selected from the preferable range (the range between about 5 degrees and about 6 degrees). Preferably, a median of the preferable range is selected. In the embodiment of FIG. 13, the median is 5.5 degrees.

In addition, a method for selecting a preferable result is not limited.

In FIG. 12, the straight line LF2 is determined from the straight line LF1. The straight line LF2 has a same inclination A1 as the straight line LF1. In the straight line LF2, a value of the intercept B is modified so that it passes through the point P4. The straight line LF2 may be used as the relational expression F1, instead of the straight line LF1. The straight line LF2 is a relational expression F1 obtained by modifying the relational expression F1 (straight line LF1) obtained based on the first hitting result (right/left deflection), on the basis of the second hitting result (flight distance ratio). In the modification, the relational expression F1 (straight line LF1) is modified so that the second hitting result (flight distance ratio) will be favorable in the head having the centroid at the center. Here, the centroid at the center is adopted as the standard centroid position Gh of the head. The centroid at the center in the embodiment means that the head centroid is located at the position which is 1.5 mm more on the heel side than on the face center.

In this manner, the two hitting results are considered in the straight line LF2. Thus, if the expression for the straight line LF2 is used as the relational expression F1, the fitting accuracy can be improved. In the standpoint of a higher fitting accuracy, more than three hitting results may be considered.

Figure 14:
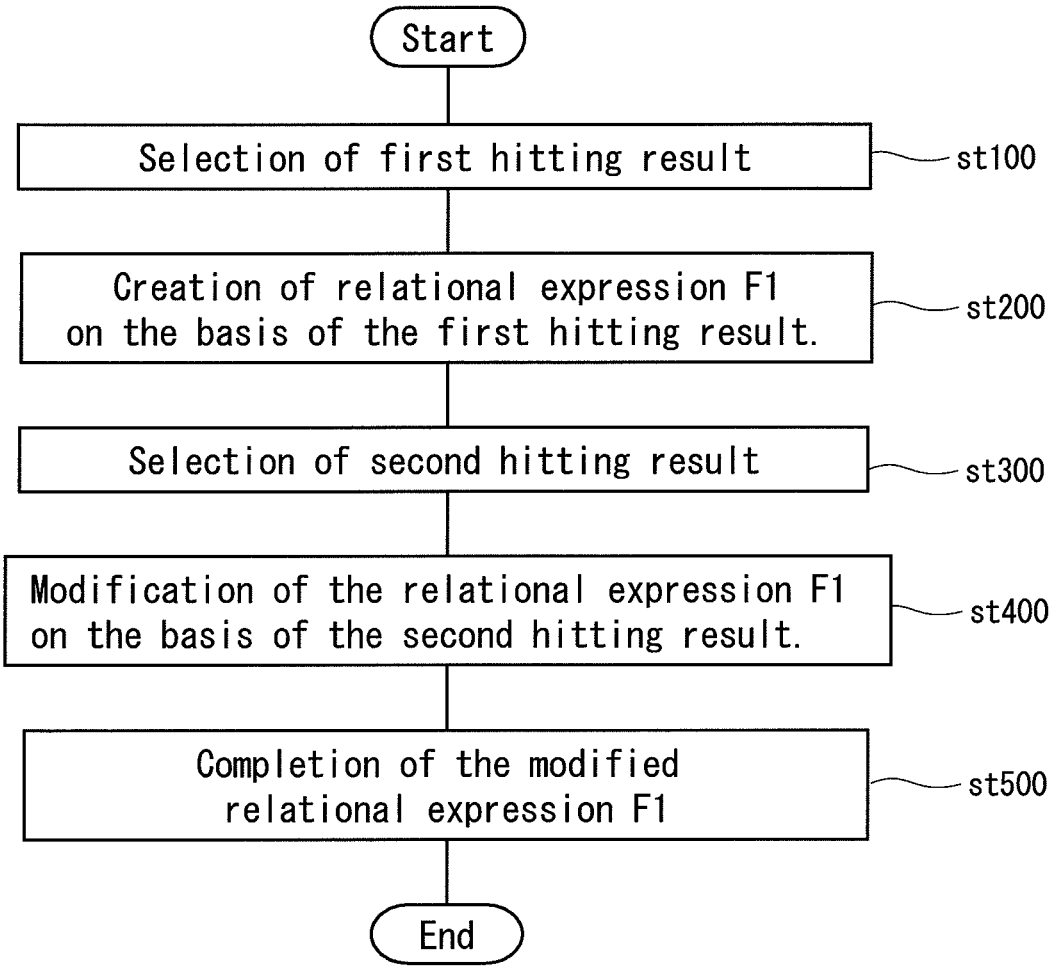
FIG. 14 is a flow chart showing a method for creating a relational expression F1 which considers two hitting results.
Figure 15:
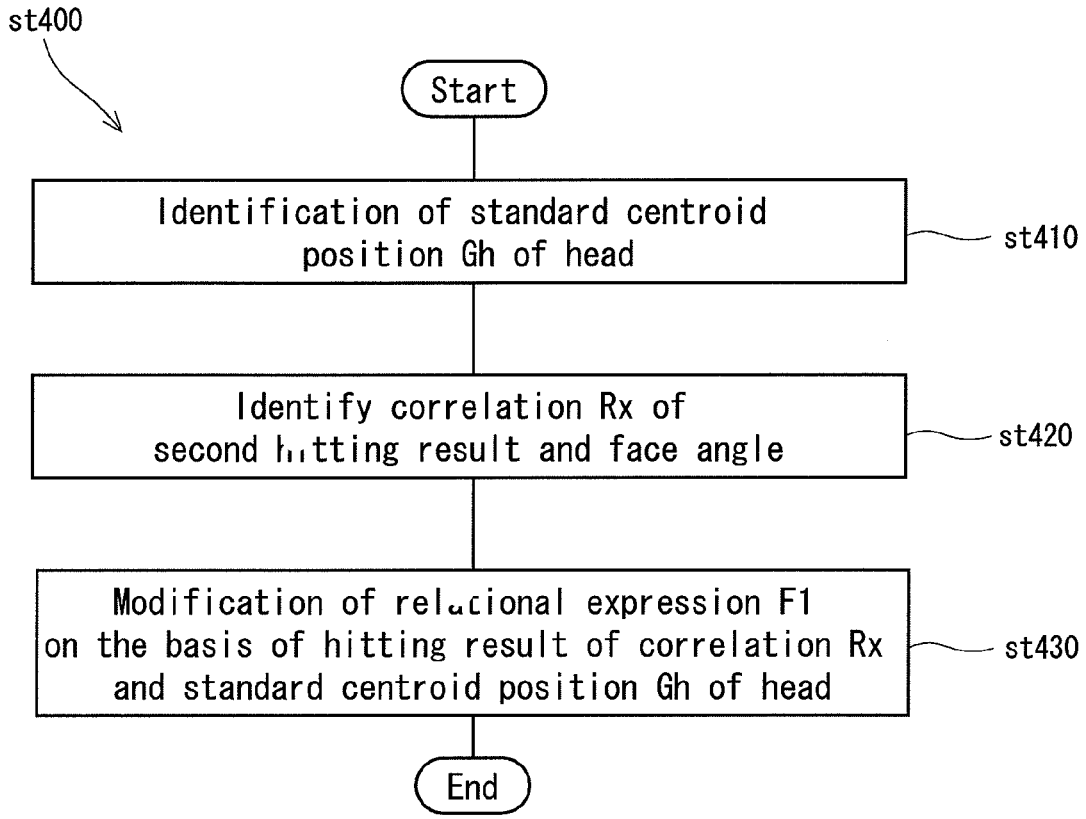
FIG. 15 is a flow chart showing a method for modification on the basis of a second hitting result.

FIG. 14 and FIG. 15 are flow charts for explaining the embodiments described above according to FIG. 10 to FIG. 13. With reference to the flow charts, each step of the above embodiment will be described.

As shown in FIG. 14, in this fitting method, a first hitting result is selected (step sp100). In the embodiment, a ball direction (right/left deflection) is selected as the first hitting result.

Then, based on the first hitting result selected in step sp100, a relational expression F1 is created (step sp200). In the embodiment, the relational expression F1 in the step sp200 is an expression of the straight line LF1.

Then, a second hitting result is selected (step sp300). In the embodiment, a flight distance is selected as the second hitting result. In the embodiment, as the flight distance, a flight distance ratio is adopted.

Then, based on the second hitting result (flight distance ratio), the relational expression F1 (expression of the straight line LF1) is modified (step sp400). In the embodiment, the modified relational expression F1 is an expression of the straight line LF2. The straight line LF2 as the modified relational expression F1 is complete (step sp500).

FIG. 15 is a flow chart showing details of the step sp400 (modification step). In the modification step, a standard centroid position Gh of the head is identified (step sp410). In the above embodiment, "1.5 mm" is adopted as the standard centroid position Gh of the head. This means that the centroid position is 1.5 mm more on the heel side than on the face center. In the embodiment, the standard centroid position Gh of the head is a position in the toe/heel direction.

Then, correlation Rx of the second hitting result and the face angle is identified (step sp420). In the embodiment, the correlation Rx is shown in the graph of FIG. 13.

Then, based on the correlation Rx, the relational expression F1 is modified (step sp430). As stated above, in the embodiment, the hitting result (second hitting result) at the standard centroid position Gh of the head is considered. In the embodiment, the point P4 based on the correlation Rx is determined, and the relational expression of the straight line LF1 is modified based on the point P4. With the modification, the straight line LF2 is obtained.

In the step sp400, at the standard centroid position Gh of the head (1.5 mm), the relational expression F1 (expression of the straight line LF1) is modified so that the second hitting result will be favorable. The correlation Rx is used to reflect preferablity of the second hitting result in the relational expression F1. In other words, in the step sp430, the modification is made so that the second hitting result (flight distance) will be favorable at the standard centroid position Gh of the head.

As described above, the favorable hitting result at the standard centroid position Gh of the head is reflected in the relational expression F1. This reflection increases correlation of the relational expression F1 and the favorable hitting result. Therefore, accuracy of the fitting can enhance.

In the following, the relational expression F1 will be described in more detail.

As stated above, for the relational expression F1, a quadratic or polynomial expression or the like may be used, in addition to a linear expression. Now, a case of a linear expression will be described.

As stated above, the linear relational expression F1 is expressed by the following expression 1:

$$Y=A1\cdot X+B \quad \text{(Expression 1)}$$

If the face angle X is Xd1 when a subject uses a test club (centroid position of the head is D1), a centroid position Y2 of the head to be recommended to the subject is determined based on the above (Expression 1) as follows:

$$Y2=A1\cdot Xd1+B$$

Preferably, in the (Expression 1), favorable hitting result at the standard centroid position Gh of the head is reflected. The relational expression F1 in which the favorable hitting result is reflected is referred to as a relational expression F1p in the following. One example of the relational expression F1p is an expression of the straight line LF2. It can be said that the relational expression F1p is a relational expression F1 which is made preferable by the standard centroid position Gh of the head. Therefore, if the centroid position D1 of the test club matches the standard centroid position Gh of the head, the relational expression F1p shows specially good accuracy.

The relational expression F1p may be used, irrespective of a centroid position of the head to be used in fitting. However, the relational expression F1p is preferable, in particular, when the centroid position D1 of the test club matches the standard centroid position Gh of the head, as described above. Thus, it is preferable that the relational expression F1p is modified based on the centroid position of the test club to be used in fitting.

The modified relational expression F1 is expressed by the following expression 2:

$$Y=A1\cdot X+B+(D1-Gh) \quad \text{(Expression 2)}$$

With the modified relational expression F1, a recommended centroid position can be determined with accuracy even if the centroid position D1 of the test club differs from the standard centroid position Gh of the head.

In the relational expression F1 of the Expression 2, the measured face angle X is made a first input variable, and a value indicating a relationship of the centroid position D1 of the head of the test club and the standard centroid position Gh of the head is made a second input variable. In the relational expression F1 of the Expression 2, the centroid position Y of the head fitted to the subject is made a result variable. With such a relational expression F1, the fitting accuracy can be improved, irrespective of the centroid position of the head to be used in fitting.

As a relational expression F1 in this application, a relational expression F11 and a relational expression F12 are exemplified. Both of the relational expression F11 and the relational expression F12 can be used in determining a head physical property fitted to a subject. In the relational expression F11, a face angle and a hitting result are considered. In the relational expression F12, a face angle and a hitting result are also considered.

The relational expression F11 is a relational expression of a face angle and a hitting result. As the relational expression F11, the straight line Lt1, the straight line Lc1, and the straight line Lh1 as shown in FIG. 11 are exemplified. As other relational expression F11, the straight line LF3, the straight line LF4, and the straight line LF5 as shown in FIG. 13 are exemplified. The relational expression F11 is used in determining a head physical property fitted to a subject. Furthermore, the relational expression F11 may also be used as the correlation Rx.

The relational expression F12 is a relational expression of a face angle and a head physical property. However, a hitting result is also considered in the relational expression F12. As the relational expression F12, the Expression 1 and the Expression 2 are exemplified. As an example of the Expression 1, the expression of the straight line LF1 and the expression of the straight line LF2 are listed. When the relational expression F12 is used, a recommended head physical property can be directly determined from a measured face angle.

A shaft may be fitted by using a head selected with the present invention. As a fitting method for the shaft, a fitting method which substitutes a shaft physical property for the head physical property in the above fitting method is exemplified. An example of a preferred shaft physical property is a flex point of a shaft.

In the embodiment, the relational expression F1 is used. The relational expression F1 is one example of a relationship C. The relationship C, which is not a relational expression, may be used.

As the relationship C, which is not a relational expression, a correspondence between a range f of face angles and a range h of head physical properties is exemplified. In this case, if a measured face angle falls within the range f, a head having a head physical property which falls within the range h is recommended. Preferably, a plurality of ranges f (f1, f2, f3, for example) is set, and a plurality of ranges h (h1, h2, h3, for example) which corresponds to each of the ranges f, is set. In this case, for example, if a measured face angle is in the range f1, a head having a head physical property which falls within the range h1 is recommended. If a measured face angle is in the range f2, a head having a head physical property which falls within the range h2 is recommended. If a measured face angle is in the range f3, a head having a head physical property which falls within the range h3 is recommended.

The relationship C is a relationship of the face angle and the head physical property. In addition to the face angle, other elements may be considered. For example, the relationship C may be a relationship of the face angle, an attack angle, and the head physical property. The relational expression F1 may be a relational expression of the face angle, the attack angle, and the head physical property. The attack angle means a direction of head path before impact. As an example of the attack angle, an angle of head path when viewed from above is listed.

EXAMPLE

In the following, effect of the invention will be revealed by an example. However, the present invention should not be interpreted in a limited way based on a description of the example.

Example 1

An indicator was determined using the analyzer shown in FIG. 7, with the analysis method shown in FIG. 8. A hitting result is a flight distance. A head physical property is a centroid position of a head. The centroid position of the head is a position in a toe/heel direction. Values of physical properties are a centroid at the center, a centroid on the heel, and a centroid on the toe.

In general, a head whose centroid position of the head is on the heel side is referred to as heel centroid. In addition, generally, a head whose centroid position of the head is on the toe side is referred to as toe centroid. The terms heel centroid and the toe centroid are known in the market as an indicator showing a centroid position of a head. However, the standards for the heel centroid and the toe centroid are not necessarily uniform in those skilled in the art. Under present circumstances, a plurality of standards of a centroid position exists.

A centroid position of a head can be quantified as a distance from an origin, for example. The origin is not limited, and is the center of a face surface, for example. In the embodiment, a centroid position of a head is indicated as a plus when it is more on the heel side than at the face center, and as a minus when it is more on the toe side than at the face center. This means that the greater a value of the centroid position of the head is, the more on the heel side the centroid position of the head is.

Images of swings of 32 golf players were shot. The 32 golf players are advanced golf players whose average score ranges from 72 to 95. The golf players hit 8 balls each with a golf club having a head of heel centroid, a golf club having a head of center centroid, and a golf club having a head of toe centroid.

In FIG. 13 described above, a relationship of the flight distance ratio of the ball as the hitting result and the face angle before impact as the indicator is shown for each value of the centroid position of the head. Here, the face angle average of the golf club 36 (center centroid) is made the horizontal axis. The face angle is an angle of the head before impact when viewed from above. The horizontal axis represents an average value of the face angle before impact of every golf player. The average value is obtained from measurement data on swings of the test club by each golf player.

The solid line LF3 of FIG. 13 shows a linear function of the golf club of center centroid. The dashed-two dotted line LF4 of FIG. 13 shows a linear function of the golf club of heel centroid. The dashed-dotted line LF5 of FIG. 13 shows a linear function of the golf club of toe centroid. The linear functions of the golf club of heel centroid and of the golf club of toe centroid are obtained by the regression analysis with the least-square method.

In this FIG. 13, concerning the function determined with the heel centroid and the toe centroid, it is judged whether or not the flight distance ratio Y differs if the face angle average X differs. For example, with this linear function, it is judged whether or not the relational expression is a function having an inclination. When the function determined with the heel centroid and the toe centroid has an inclination, and when the flight distance is made an objective variable with the face angle as an explanatory variable, it can be judged that the face angle has a statistically significant relation with the flight distance.

When an inclination of the function determined with the heel centroid differs from that of the function determined with the toe centroid, and when the flight distance is made an objective variable and the face angle and a value of the centroid position of the head are made an explanatory objective, it is judged that the face angle and the value of the centroid position of the head have a statistically significant relation with the flight distance. It is judged that the face angle and the value of the centroid position of the head have a relation of interaction. In this manner, it is judged whether or not there is a statistically significant relation. For example, it is made a judging standard whether or not a product of the face angle and the value of the centroid position of the head is significant on the level of 20%. More preferably, it is made a judging standard whether or not the product is significant on the level of 10%.

In this FIG. 13, an inclination of the linear function (straight line LF4) determined with the golf club of heel centroid is 0.0028. An inclination of the linear function (straight line LF5) determined with the golf club of toe centroid is −0.0033. The inclinations are formed with respect to the function of the club of center centroid. When the flight distance is made an objective variable with the face angle as an explanatory variable, the face angle has a statistically significant relation with the flight distance. It is judged that the flight distance which is made an objective variable has a statistically significant relation with the face angle and the value of centroid position of the head which are made an explanatory variable. It is judged that the face angle and the value of the centroid position of the head have an interaction. An indicator for which the significant difference is great considerably contributes to a flight distance as a hitting result. The straight lines LF3, the straight line LF4, and the straight line LF5 are one example of a relational expression F1.

The above description is just one example, and various changes can be made without departing from the essence of the present invention.

What is claimed is:

1. A fitting method of a golf club, comprising the steps of:
performing the following steps by a processor;
preparing a relationship C in which a face angle at or before impact and a hitting result are considered when a plurality of golf players swing using a plurality of golf clubs with different head physical property values;
obtaining measurement result of the face angle by a subject (golf player) hitting a ball with a test club; and
determining a head physical property fitted to the subject on the basis of the relationship C and the measurement result of the face angle,
wherein:
the relationship C is a relational expression F1,
the relational expression F1 is a relational expression F12 of the face angle and the head physical property,
in the relational expression F12, correlation Rx of the hitting result and the face angle is considered,
the head physical property is a centroid position of a head, a lie angle, a bulge on the face surface or a moment of inertia of the head, and
the relational expression F12 is a relational expression in which the greater the face angle to be measured is, the more at the heel side the recommended centroid position of head is.

2. The fitting method according to claim 1, wherein in the relational expression 12, a preferred hitting result at a standard centroid position Gh of the head is reflected.

3. The fitting method according to claim 1, wherein in the relational expression F12, more than two hitting results are considered.

4. The fitting method according to claim 3 wherein the relational expression F12 is created by modifying a relational expression based on a first hitting result, on the basis of a second hitting result.

5. The fitting method according to claim 4 wherein the modification based on the second hitting result is such a modification that the second hitting result is preferable at the standard centroid position Gh of the head.

6. The fitting method according to claim 4 wherein
the first hitting result is a direction of a hit ball; and
the second hitting result is a flight distance.

7. A fitting method of a golf club, comprising the steps of:
performing the following steps by a processor;
preparing a relationship C in which a face angle at or before impact and a hitting result are considered when a plurality of golf players swing using a plurality of golf clubs with different head physical property values;

obtaining measurement result of the face angle by a subject (golf player) hitting a ball with a test club; and determining a head physical property fitted to the subject on the basis of the relationship C and the measurement result of the face angle, wherein:

the relationship C is a relational expression F1, the relational expression F1 is a relational expression F12 of the face angle and the head physical property, in the relational expression F12, correlation Rx of the hitting result and the face angle is considered, the head physical property is a centroid position of a head, and in the relational expression F12, the measured face angle is made a first input variable:

a value showing a relationship of a centroid position D1 of a head of the test club and the standard centroid position Gh of the head is made a second input variable; and the centroid position Y of the head fitted to the subject is made a result variable.

8. The fitting method according to claim 1 wherein the head physical property is a centroid position of a head.

9. The fitting method according to claim 1 wherein the relational expression F1 is a linear expression.

10. The fitting method according to claim 1 wherein the hitting result is a right/left direction in which a ball flies.

11. A fitting method of a golf club comprising the steps of:

performing the following steps by a processor;

acquiring measurement data and hitting results of a plurality of golf players using a plurality of golf clubs with different values of head physical properties;

obtaining a characteristic value on the basis of the measurement data;

determining an indicator for selecting a head of a golf club from the characteristic value and the hitting results;

obtaining a relational expression F1 of the indicator and the hitting results for each value of the head physical properties;

obtaining measurement result corresponding to the indicator by a subject (golf player) hitting a ball with a test club; and determining a head physical property fitted to the subject on the basis of the relational expression F1 and the measurement result, wherein in the step of obtaining multiple pieces of measurement data and hitting results, the multiple pieces of measurement data are obtained from swings of the golf players and hit balls of the swings, and in the step of determining an indicator, when the hitting results are made an objective variable, the characteristic value and values of the head physical properties are made an explanatory variable, and the characteristic value has a statistically significant relation with the hitting results, the characteristic value is determined as the indicator, wherein:

the hitting result is a flight distance of a ball, the head physical property is a centroid position of a head, a lie angle, a bulge on the face surface or a moment of inertia of the head, and the characteristic value is a face angle before impact or at impact.

12. The fitting method according to claim 11 wherein in the step of determining an indicator, a plurality of indicators is determined, and the method further comprising the steps of:

calculating an accuracy rate of values of head physical properties determined from the plurality of indicators; and selecting an indicator to be used in fitting of a golf club, on the basis of the accuracy rate, wherein in the step of calculating an accuracy rate of values of head physical properties, a value Xa of the fit head physical property is selected based on a relational expression F1 of the indicator and the hitting results, a value Xb of the fit head physical property is determined based on values of hitting results obtained from the swings, and a golf player rate for which the value Xa and the value Xb match is calculated, and the rate is made an accuracy rate, and in the step of selecting an indicator to be used in fitting of a golf club, an indicator for which the accuracy rate is highest is selected to be an indicator to be used in fitting.

13. A fitting method of a golf club comprising the steps of:

performing the following steps by a processor;

acquiring measurement data and hitting results of a plurality of golf players using a plurality of golf clubs with different values of head physical properties;

obtaining a characteristic value on the basis of the measurement data;

determining an indicator for selecting a head of a golf club from the characteristic value and the hitting results;

obtaining a relational expression F1 of the indicator and the hitting results for each value of the head physical properties;

obtaining measurement result corresponding to the indicator by a subject (golf player) hitting a ball with a test club; and determining a head physical property fitted to the subject on the basis of the relational expression F1 and the measurement result, wherein in the step of obtaining multiple pieces of measurement data and hitting results, the multiple pieces of measurement data are obtained from swings of the golf players and hit balls of the swings, and in the step of determining an indicator, when the hitting results are made an objective variable, the characteristic value and values of the head physical properties are made an explanatory variable, and the characteristic value has a statistically significant relation with the hitting results, the characteristic value is determined as the indicator, wherein the hitting result is a right/left direction in which a ball flies;

the head physical property is a centroid position of a head, a lie angle, a bulge on the face surface or a moment of inertia of the head; and the characteristic value is a face angle before impact or at impact.

14. A fitting method of a golf club comprising the steps of:

performing the following steps by a processor;

acquiring measurement data and hitting results of a plurality of golf players using a plurality of golf clubs with different values of head physical properties;

obtaining a characteristic value on the basis of the measurement data;

determining an indicator for selecting a head of a golf club from the characteristic value and the hitting results;

obtaining a relational expression F1 of the indicator and the hitting results for each value of the head physical properties;

obtaining measurement result corresponding to the indicator by a subject (golf player) hitting a ball with a test club; and determining a head physical property fitted to the subject on the basis of the relational expression F1 and the measurement result, wherein in the step of obtaining multiple pieces of measurement data and hitting results, the multiple pieces of measurement data are obtained from swings of the golf players and hit balls of the swings, and in the step of determining an indicator, when the hitting results are made an objective variable, the characteristic value and values of the head physical properties are made an explanatory variable, and the characteristic value has a statistically significant relation with the hitting results, the characteristic value is determined as the indicator, wherein the head physical property is a centroid position of a head, the indicator is a face angle before impact or at impact, a value X of a face angle for which an absolute value of a direction in which a ball flies is 0 is determined for each of the value Y of the centroid position of the head, an approximate expression which satisfies a relationship of the value Y of each centroid position of a plurality of heads and the value X of the face angle $$Y=A1\cdot X+B$$

(coefficient A1 and intercept B are a constant)

is determined, and the approximate expression is the relational expression F1.

15. The fitting method according to claim 14 wherein the intercept B is modified based on a relationship of the flight distance of the ball and the value of the face angle.

16. An analysis method of swings of a golf club, comprising steps of:

performing the following steps by a processor;

acquiring multiple pieces of measurement data and hitting results of a plurality of golf players using a plurality of golf clubs with different values of head physical properties;

obtaining a characteristic value on the basis of the measurement data;

determining an indicator for selecting a head of a golf club from the characteristic value and the hitting results; and obtaining a relational expression F1 of the indicator and the hitting results for each value of the head physical properties; wherein in the step of obtaining multiple pieces of measurement data and hitting results, the multiple pieces of measurement data are obtained from swings of the golf players and hit balls of the swings, and in the step of determining an indicator, when the hitting results are made an objective variable, the characteristic value and values of the head physical properties are made an explanatory variable, and the characteristic value has a statistically significant relation with the hitting results, the characteristic value is determined as the indicator, wherein:

the hitting result is a flight distance of a ball, the head physical property is a centroid position of a head, a lie angle, a bulge on the face surface or a moment of inertia of the head, and the characteristic value is a face angle before impact or at impact.

17. The analysis method according to claim 16 wherein in the step of determining an indicator, a plurality of indicators is determined, and the method further comprising the steps of:

calculating an accuracy rate of values of head physical properties determined from the plurality of indicators; and selecting an indicator to be used in fitting of a golf club, on the basis of the accuracy rate, wherein in the step of calculating an accuracy rate of values of head physical properties, a value Xa of the fit head physical property is selected based on a relational expression F1 of the indicator and the hitting results, a value Xb of the fit head physical property is determined based on values of hitting results obtained from the swings, and a golf player rate for which the value Xa and the value Xb match is calculated, and the rate is made an accuracy rate, and in the step of selecting an indicator to be used in fitting of a golf club, an indicator for which the accuracy rate is highest is selected to be an indicator to be used in fitting.

18. An analysis method of swings of a golf club, comprising steps of:

performing the following steps by a processor;

acquiring multiple pieces of measurement data and hitting results of a plurality of golf players using a plurality of golf clubs with different values of head physical properties;

obtaining a characteristic value on the basis of the measurement data;

determining an indicator for selecting a head of a golf club from the characteristic value and the hitting results; and obtaining a relational expression F1 of the indicator and the hitting results for each value of the head physical properties; wherein in the step of obtaining multiple pieces of measurement data and hitting results, the multiple pieces of measurement data are obtained from swings of the golf players and hit balls of the swings, and in the step of determining an indicator, when the hitting results are made an objective variable, the characteristic value and values of the head physical properties are made an explanatory variable, and the characteristic value has a statistically significant relation with the hitting results, the characteristic value is determined as the indicator, wherein the hitting result is a right/left direction in which a ball flies;

the head physical property is a centroid position of a head, a lie angle, a bulge on the face surface or a moment of inertia of the head; and the characteristic value is a face angle before impact or at impact.

19. The fitting method according to claim 7, wherein in the relational expression 12, a preferred hitting result at a standard centroid position Gh of the head is reflected.

20. The fitting method according to claim 7, wherein in the relational expression F12, more than two hitting results are considered.

21. The fitting method according to claim 7, wherein the relational expression F1 is a linear expression.

22. The fitting method according to claim 13, wherein in the step of determining an indicator, a plurality of indicators is determined, and the method further comprising the steps of:

calculating an accuracy rate of values of head physical properties determined from the plurality of indicators; and selecting an indicator to be used in fitting of a golf club, on the basis of the accuracy rate, wherein in the step of calculating an accuracy rate of values of head physical properties, a value Xa of the fit head physical property is selected based on a relational expression F1 of the indicator and the hitting results, a value Xb of the fit head physical property is determined based on values of hitting results obtained from the swings, and a golf player rate for which the value Xa and the value Xb match is calculated, and the rate is made an accuracy rate, and in the step of selecting an indicator to be used in fitting of a golf club, an indicator for which the accuracy rate is highest is selected to be an indicator to be used in fitting.

23. The fitting method according to claim 14, wherein in the step of determining an indicator, a plurality of indicators is determined, and the method further comprising the steps of:

calculating an accuracy rate of values of head physical properties determined from the plurality of indicators; and selecting an indicator to be used in fitting of a golf club, on the basis of the accuracy rate, wherein in the step of calculating an accuracy rate of values of head physical properties, a value Xa of the fit head physical property is selected based on a relational expression F1 of the indicator and the hitting results, a value Xb of the fit head physical property is determined based on values of hitting results obtained from the swings, and a golf player rate for which the value Xa and the value Xb match is calculated, and the rate is made an accuracy rate, and in the step of selecting an indicator to be used in fitting of a golf club, an indicator for which the accuracy rate is highest is selected to be an indicator to be used in fitting.

24. The analysis method according to claim 18, wherein in the step of determining an indicator, a plurality of indicators is determined, and the method further comprising the steps of:

calculating an accuracy rate of values of head physical properties determined from the plurality of indicators; and selecting an indicator to be used in fitting of a golf club, on the basis of the accuracy rate, wherein in the step of calculating an accuracy rate of values of head physical properties, a value Xa of the fit head physical property is selected based on a relational expression F1 of the indicator and the hitting results, a value Xb of the fit head physical property is determined based on values of hitting results obtained from the swings, and a golf player rate for which the value Xa and the value Xb match is calculated, and the rate is made an accuracy rate, and in the step of selecting an indicator to be used in fitting of a golf club, an indicator for which the accuracy rate is highest is selected to be an indicator to be used in fitting.

* * * * *